US005271531A

United States Patent [19]

Rohr et al.

[11] Patent Number: 5,271,531

[45] Date of Patent: Dec. 21, 1993

[54] DISPENSING CLOSURE WITH PRESSURE-ACTUATED FLEXIBLE VALVE

[75] Inventors: Robert D. Rohr, Elgin; John M. Hess, III, Crystal Lake, both of Ill.

[73] Assignee: Seaquist Closures, a division of Pittway Corp., Mukwonago, Wis.

[21] Appl. No.: 54,863

[22] Filed: Apr. 27, 1993

Related U.S. Application Data

[63] Continuation of Ser. No. 749,544, Aug. 23, 1991, abandoned, which is a continuation-in-part of Ser. No. 641,456, Jan. 14, 1991, abandoned.

[51] Int. Cl.[5] ..... B65D 37/00

[52] U.S. Cl. ..... 222/212; 215/232; 220/259; 222/490; 222/494

[58] Field of Search ..... 222/206, 212, 215, 490, 222/491, 494; 215/232, 306; 220/259

[56] References Cited

U.S. PATENT DOCUMENTS

| | | | |
|---|---|---|---|
| 1,739,871 | 12/1929 | Smith | 222/490 |
| 1,989,714 | 2/1935 | Statham | 221/60 |
| 3,281,000 | 10/1966 | Lowen | 215/041 |
| 4,646,945 | 3/1987 | Steiner et al. | 222/490 X |
| 4,735,334 | 4/1988 | Abbott | 220/259 |
| 4,969,581 | 11/1990 | Seifert et al. | 222/494 X |
| 4,991,745 | 2/1991 | Brown | 222/494 X |
| 5,033,647 | 7/1991 | Smith et al. | 222/494 X |

FOREIGN PATENT DOCUMENTS

| | | | |
|---|---|---|---|
| 251478 | 6/1964 | Austria | 222/490 |
| 0253495 | 1/1988 | European Pat. Off. | 222/494 |
| 2354093 | 5/1975 | Fed. Rep. of Germany | 222/491 |
| 1474620 | 9/1974 | United Kingdom . | |

OTHER PUBLICATIONS

Search Report for EP 92 10 0468 and annex thereto (issued May 18, 1992 with a search completion date of Apr. 6, 1992.

Search report for EP 92 10 0468 and annex thereto (issued Aug. 27, 1992 with a search completion date of Jul. 9, 1992).

*Primary Examiner*—Andres Kashnikow
*Assistant Examiner*—Joseph A. Kaufman
*Attorney, Agent, or Firm*—Dressler, Goldsmith, Shore & Milnamow, Ltd.

[57] ABSTRACT

A dispensing closure is provided for an opening in an squeeze-type container and includes a body defining a dispensing passage for communicating between the container interior and the container exterior through a container opening. A flexible, self-sealing valve is mounted in the body for opening in response to increased container pressure. A retaining ring is provided for retaining the valve in the body.

4 Claims, 16 Drawing Sheets

Fig. 5
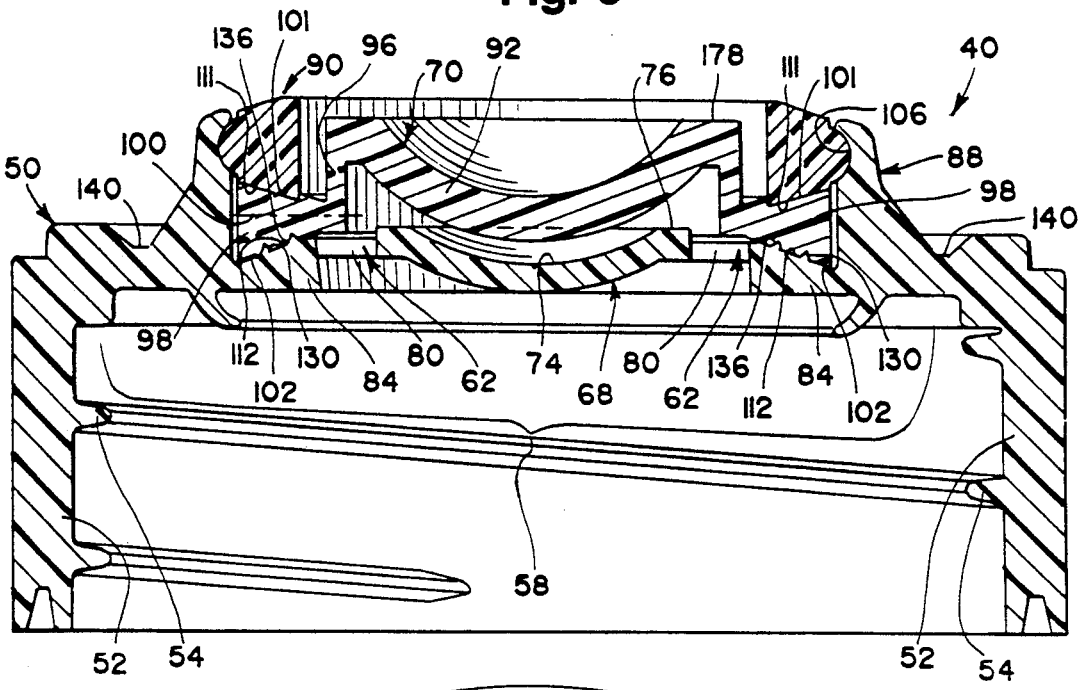
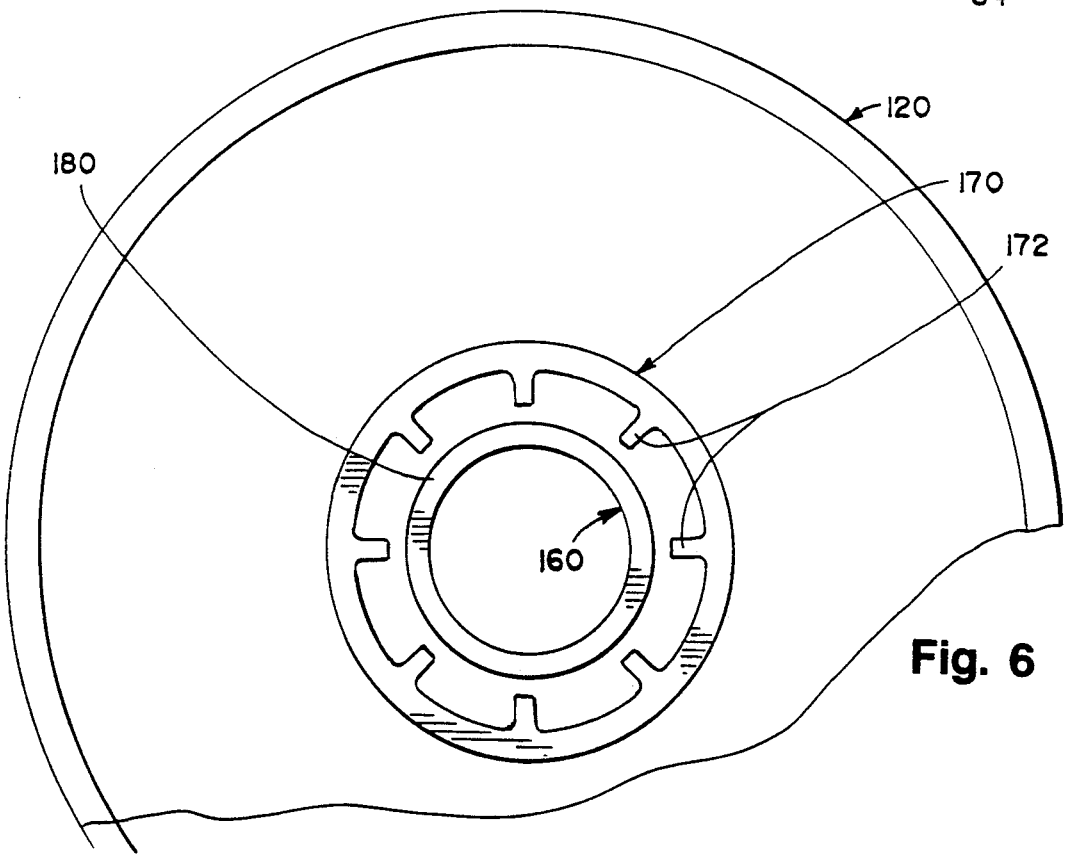
Fig. 6

Fig. 14
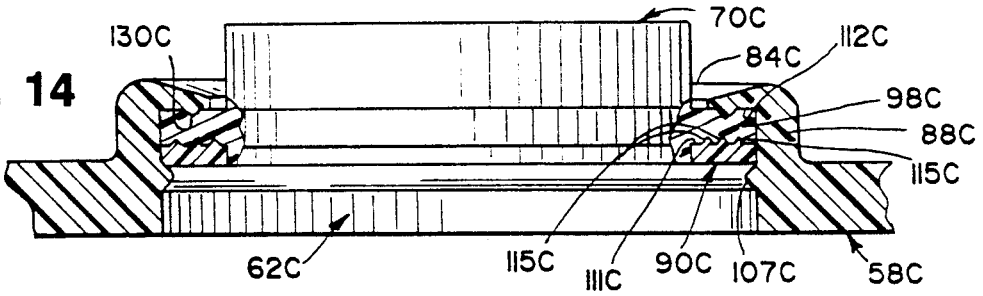
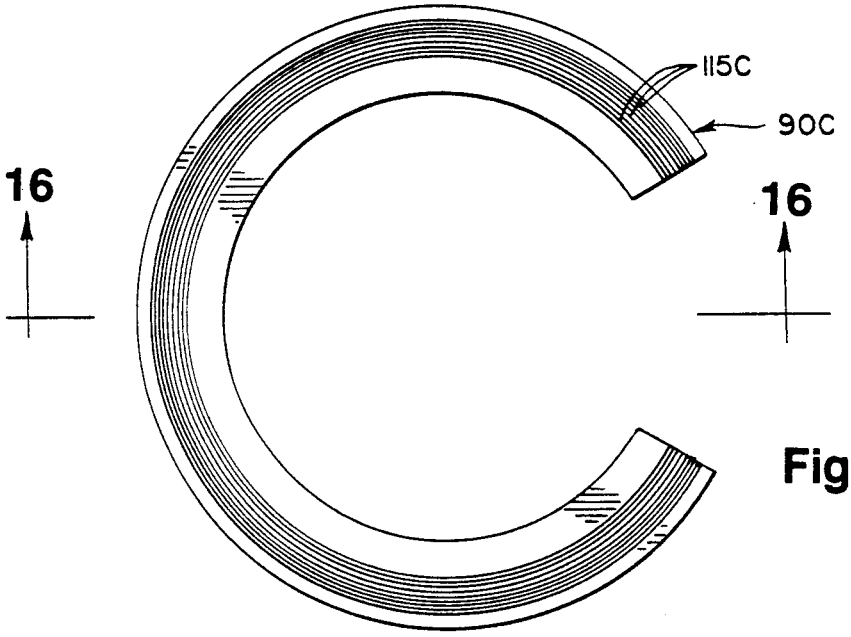
Fig. 15
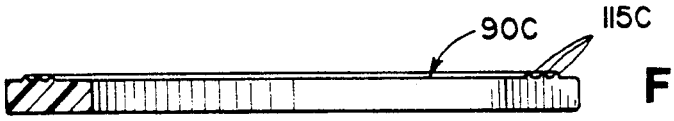
Fig. 16
Fig. 17
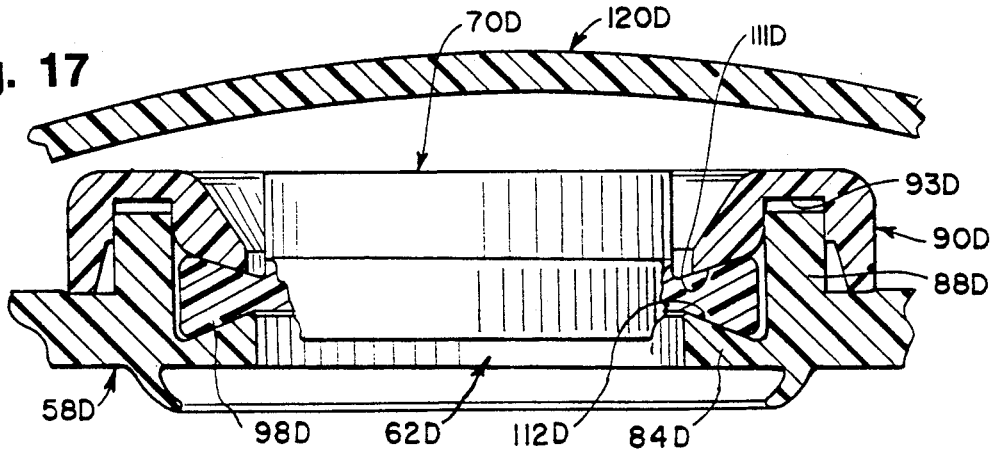

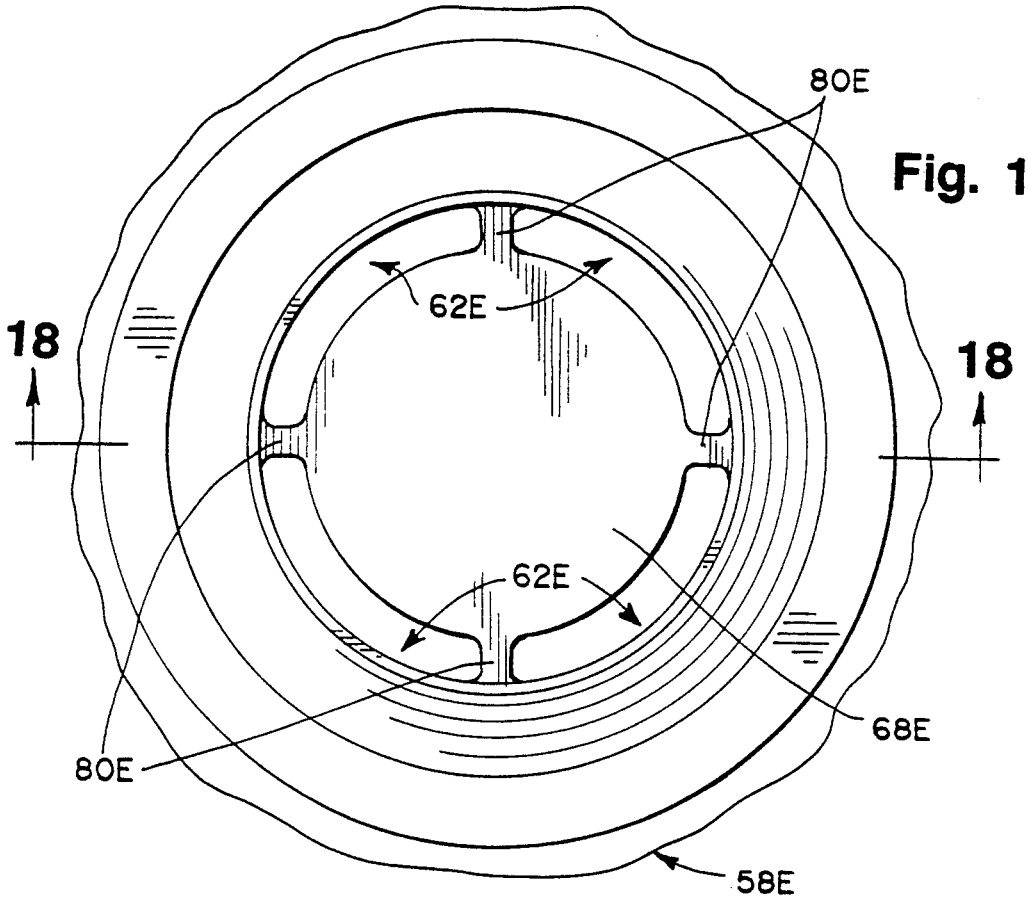
Fig. 19
Fig. 18
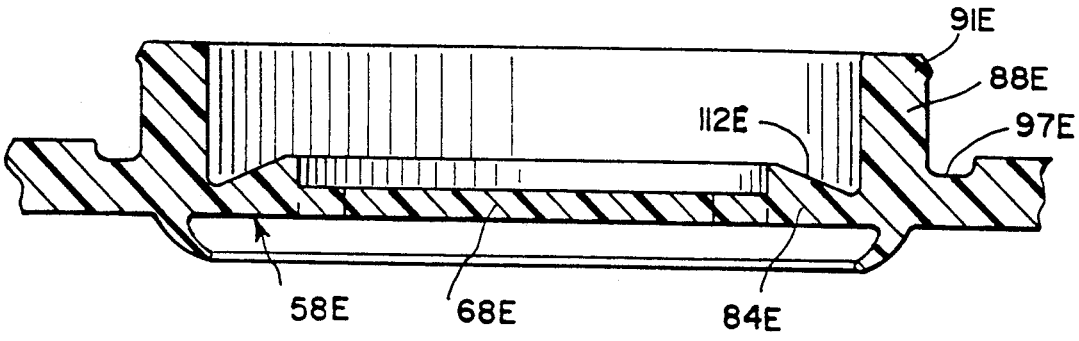

Fig. 26
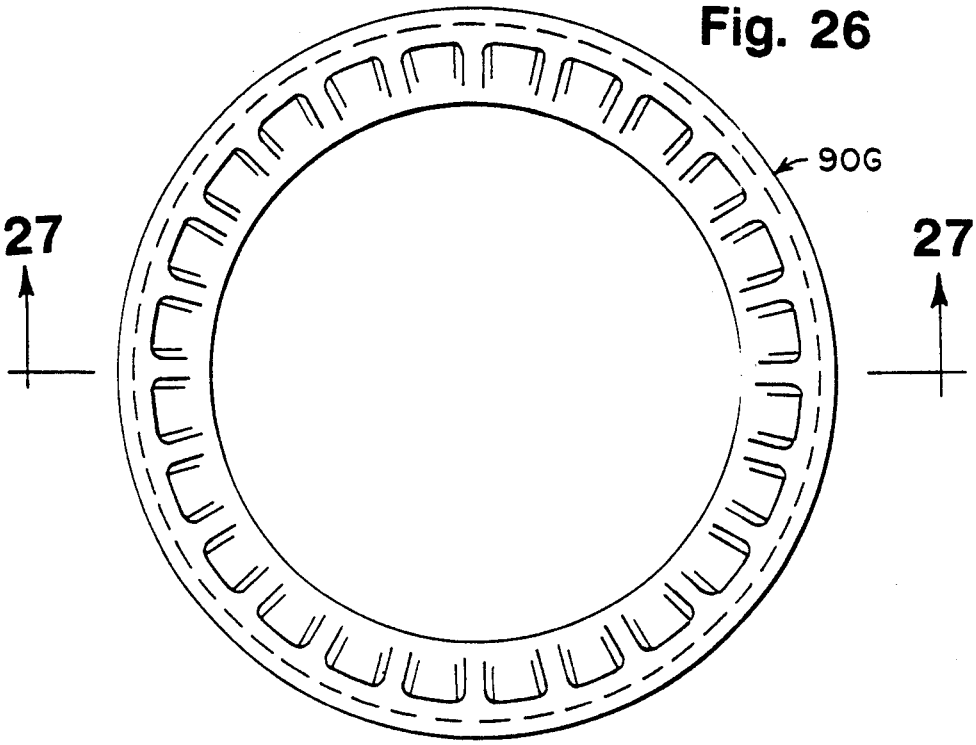
Fig. 27
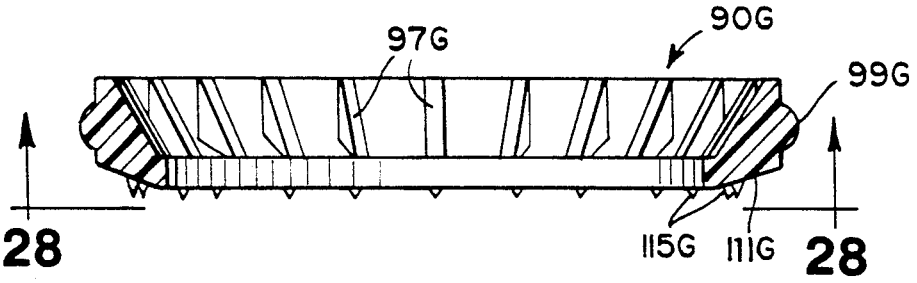
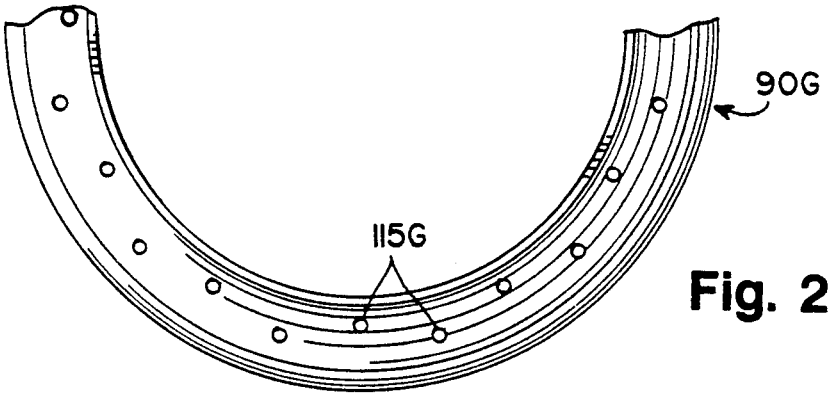
Fig. 28

Fig. 31
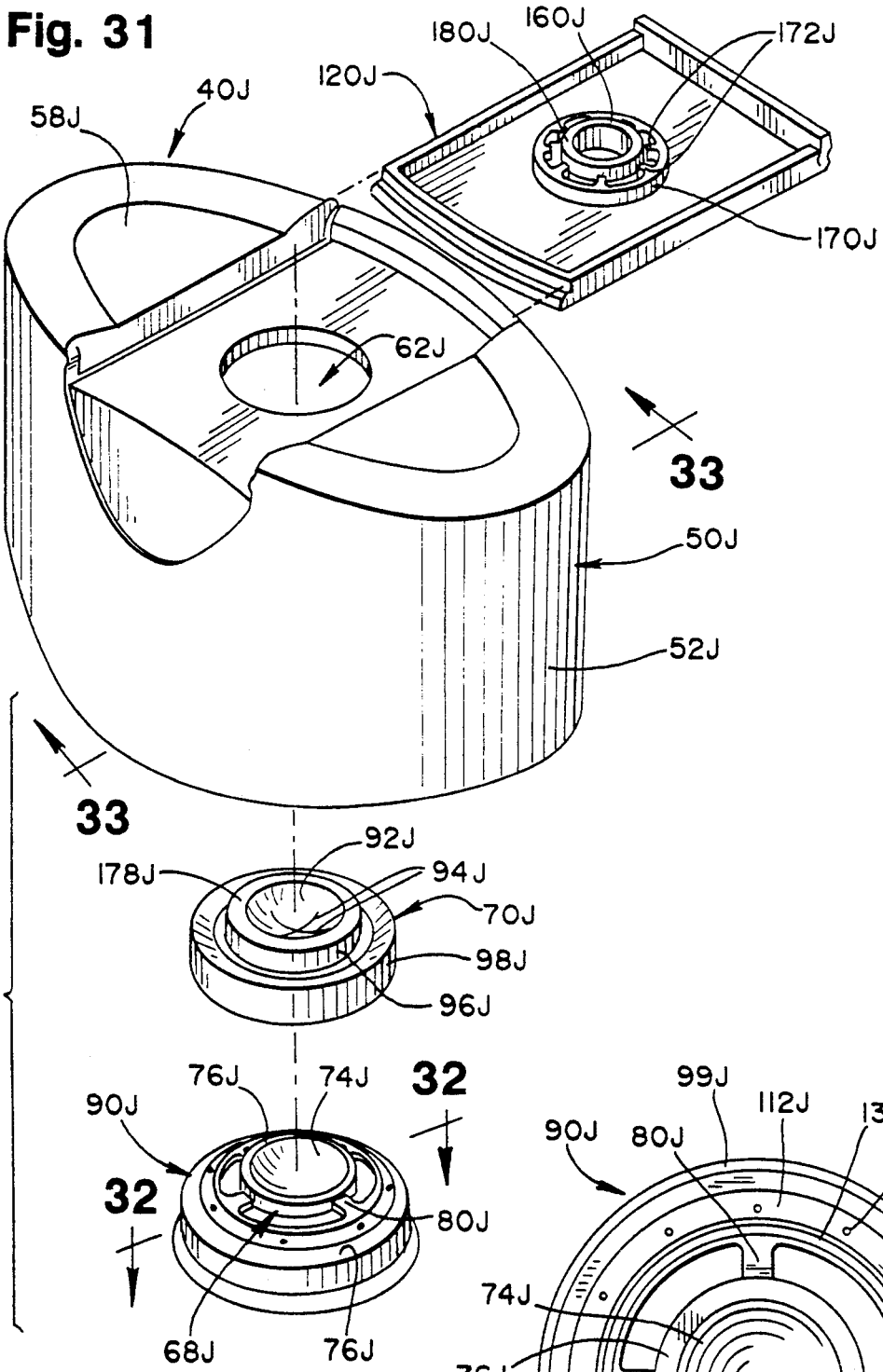
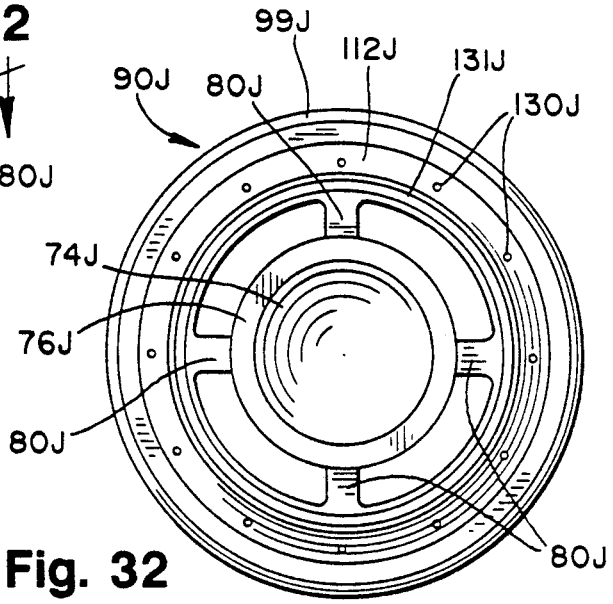
Fig. 32

Fig. 33
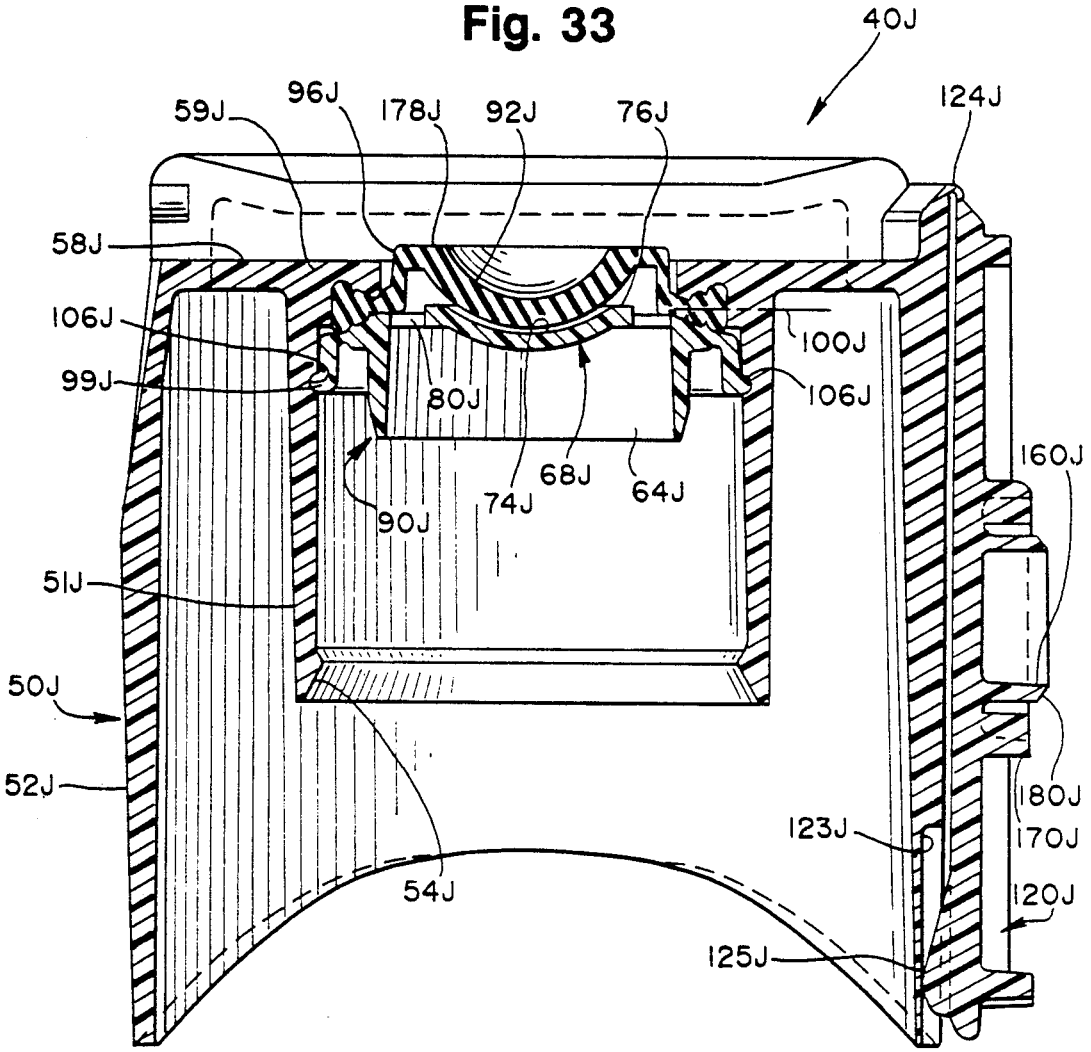
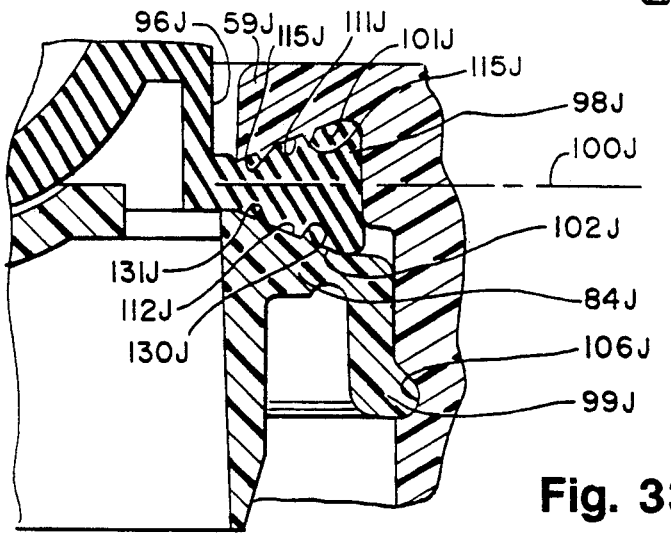
Fig. 33A

DISPENSING CLOSURE WITH PRESSURE-ACTUATED FLEXIBLE VALVE

CROSS REFERENCE TO RELATED APPLICATION

This application is a continuation of application Ser. No. 07/749,544, filed Aug. 23, 1991 now abandoned a continuation-in-part application of co-pending U.S. patent application Ser. No. 07/641,456 filed on Jan. 14, 1991 by Robert D. Rohr and John Miller Hess III now abandoned.

1. Technical Field

This invention relates to container closures, and more particularly to a squeeze-type container dispensing closure which opens to dispense a fluid product from the container when the container is squeezed and which automatically closes when the squeezing pressure is released.

2. Background of the Invention and Technical Problems Posed by the Prior Art

A variety of packages, including dispensing packages or containers, have been developed for personal care products such as shampoo, lotions, etc., as well as or other fluid materials. Closures for these types of containers typically have a flexible, self-sealing, slit-type dispensing valve mounted over the container opening. When the container is squeezed, the fluid contents of the container are discharged through the valve.

While closures used for such packages may function generally satisfactorily, there is a need for an improved closure which can be more easily manufactured and assembled with reduced manufacturing costs.

Also, it would be advantageous if such an improved closure could be provided with a design that would accommodate high speed, high quantity manufacturing techniques with a reduced product reject rate.

With some conventional designs, there is a danger that the flexible, self-sealing, dispensing valve may be partially or completely dislodged from the container closure. This would permit the container contents to spill out. Also, there is a danger that a small child might attempt to swallow the loose valve. In view of these potential problems, it would be desirable to provide a closure design having an improved valve sealing and retention capability.

In addition, it would be beneficial if the design of such an improved closure could accommodate use of the closure with a variety of conventional containers having a variety of conventional container finishes, such as conventional threaded and snap-fit attachment configurations.

SUMMARY OF THE INVENTION

The present invention provides a dispensing closure suitable for an opening in a squeeze-type container. The closure includes a body for attachment to the container at the container opening to define a dispensing passage for communicating between the container interior and exterior through the container opening.

Carried within the body is a flexible, self-sealing valve of the type which opens in response to increased container pressure. The valve is disposed in the body across the dispensing passage.

The closure includes one or more unique features. One feature is a retaining means for retaining the valve in the body. In one preferred embodiment, this includes a peripheral flange on the valve which is oriented to define a central plane generally transverse to the discharge passage. The thickness of the flange normal to the plane is greater at the peripheral radial edge of the flange than inwardly thereof. The flange defines first and second engagement surfaces symmetrically arranged on opposite sides of the central plane.

First and second spaced-apart clamping members are provided on the closure body to extend peripherally around at least a portion of the dispensing passage. The first and second clamping members define generally opposed, spaced-apart first and second clamping surfaces, respectively, for clamping the valve flange engagement surfaces. The spacing between the clamping surfaces is less at a location adjacent the dispensing passage than at a location outwardly therefrom. The clamping surfaces are symmetrically arranged on opposite sides of the valve flange central plane.

Another feature which may be optionally included in the closure is a structural configuration that prevents "doming" or upwardly convex distortion of the closure when it is applied to the container. Such distortion may, if not minimized or controlled, lead to inadequate retention of the valve and/or looseness of the valve in the closure. In an extreme case, the valve might even be expelled from the closure during use.

To overcome this problem, the valve closure body is provided with a skirt for securing the body to the container. The body has an annular top wall extending inwardly from the skirt to define the dispensing passage and to define a means, such as a collar, for receiving the valve. The body includes flexure means for permitting outward displacement of the valve receiving means with a minimum of distortion. The flexure means includes an annular channel in the top wall located radially outwardly of the valve receiving means and opening upwardly to define a reduced thickness section of the top wall so as to accommodate elongation of the section when the top wall is engaged by the container to which the body is secured. This permits the top wall to be moved upwardly in a generally planar configuration without bulging.

Another feature which may optionally be included in the closure is a structure for insuring the sealing of the valve when it is not being used to dispense the contents from the container. In particular, the closure includes a valve having a flexible central wall disposed across at least a portion of the dispensing passage and defining at least one normally closed dispensing slit.

The body includes a support member spaced below the valve central wall. Further, a lid is provided for being disposed on the body in a closed position over the valve. The lid includes an annular sealing collar for engaging the valve central wall at a location radially outwardly of the dispensing slit so as to force the valve central wall against the support member to seal the valve closed around the slit.

Another optional feature which may be included in the closure relates to an improved valve retention structure. The valve is provided with a peripheral, flexible flange, and first and second spaced-apart clamping members on the body extend peripherally around at least a portion of the discharge passage to clamp the valve flange. The first and second clamping members define generally opposed, spaced-apart first and second clamping surfaces for clamping the valve flange. At least one of the clamping surfaces includes a projecting protrusion, such as a spike, or plurality of spikes, to aid in retaining the valve flange between the clamping members.

Another optional valve retention structure that may be provided in the closure also requires the valve to have a peripheral flange. The closure body defines the seat for receiving the valve flange and defines a cylindrical wall or collar around the valve seat to surround the periphery of the valve flange and to receive a novel retaining ring. The ring is attached to a part of the closure body such as the collar. The ring engages the valve flange and retains the valve in the closure body. Various embodiments of the retaining ring have one or more of the following novel features:

(a) a clamping surface for engaging the valve flange wherein the clamping surface lies at an oblique angle to a plane oriented transversely of the dispensing passage;

(b) a clamping surface with a plurality of spaced-apart protrusions;

(c) a clamping surface adapted to face the container and having at least one gripping ring;

(d) a channel for engaging an end of the collar in a snap-fit engagement; and (e) a snap-fit engagement with the collar on the outer side of the valve flange relative to the container interior.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 5 is a greatly enlarged, cross-sectional view taken generally along the plane 5—5 in FIG. 2;

FIG. 6 is a greatly enlarged, fragmentary, plan view of the underside of the closure lid taken generally along the plane 6—6 in FIG. 2;

FIG. 14 is a view similar to FIG. 13, but showing a fourth embodiment of the closure;

FIG. 15 is a plan view of an insert ring for the closure illustrated in FIG. 14;

FIG. 16 is a cross-sectional view taken generally along the plane 16—16 in FIG. 15;

FIG. 17 is a view similar to FIG. 14, but showing a fifth embodiment of the closure;

FIG. 18 is a fragmentary, cross-sectional view taken generally along the plane 18—18 in FIG. 19 and showing a sixth embodiment of the closure with the valve and lid removed for purposes of illustrating interior details;

FIG. 19 is a fragmentary, plan view of the body of the closure shown in FIG. 18;

FIG. 26 is a plan view of an embodiment of an insert ring that may be employed with the closure body illustrated in FIGS. 24 and 25;

FIG. 27 is a cross-sectional view taken generally along the plane 27—27 in FIG. 26;

FIG. 28 is a fragmentary, plan view of the insert ring taken along the plane 28—28 in FIG. 27;

FIG. 31 is a perspective view of another, and preferred, embodiment of the closure of the present invention showing the closure body and lid in the as molded orientation and showing the internal components in an exploded, perspective arrangement;

FIG. 32 is an enlarged plan view of the retaining member taken generally along the plane 32—32 in FIG. 31;

FIG. 33 is a cross-sectional view taken generally along the plane 33—33 in FIG. 31 but showing the lid in a fully opened position; and FIG. 33A is a greatly enlarged, fragmentary, cross-sectional view of the valve flange clamping region shown in FIG. 33;

DESCRIPTION OF THE PREFERRED EMBODIMENTS

Figure 1:
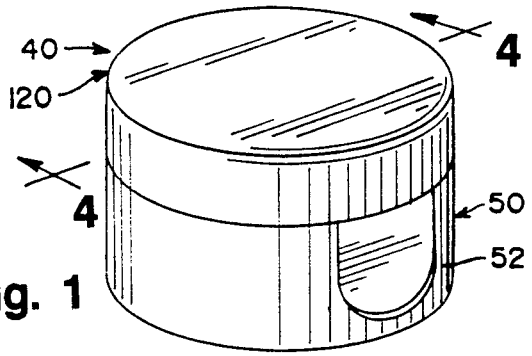
FIG. 1 is a perspective view of one form of a closure of the present invention showing an optional lid in a closed position on the closure.

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the closure of this invention is described in the normal (upright) operating position, and terms such as upper, lower, horizontal, etc., are used with reference to this position. It will be understood, however, that the closure of this invention may be manufactured, stored, transported, used, and sold in an orientation other than the position described.

With reference to the figures, a first embodiment of the closure of the present invention is illustrated in FIGS. 1-9 and 11 and is represented generally in many of those figures by reference numeral 40. The closure 40 is adapted to be disposed on a container, such as a container 42 (FIG. 11), which has a conventional mouth or opening formed by a neck 44 or other suitable structure The closure 40 may be fabricated from a thermoplastic material, or other materials, compatible with the container contents.

Figure 3:
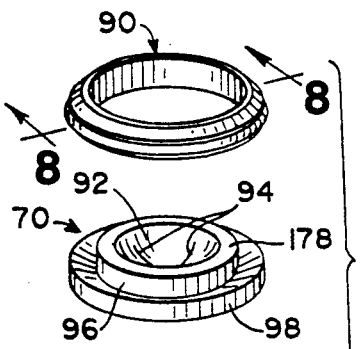
FIG. 3 is a view similar to FIG. 2, but showing the internal components in an exploded, perspective arrangement.
Figure 2:
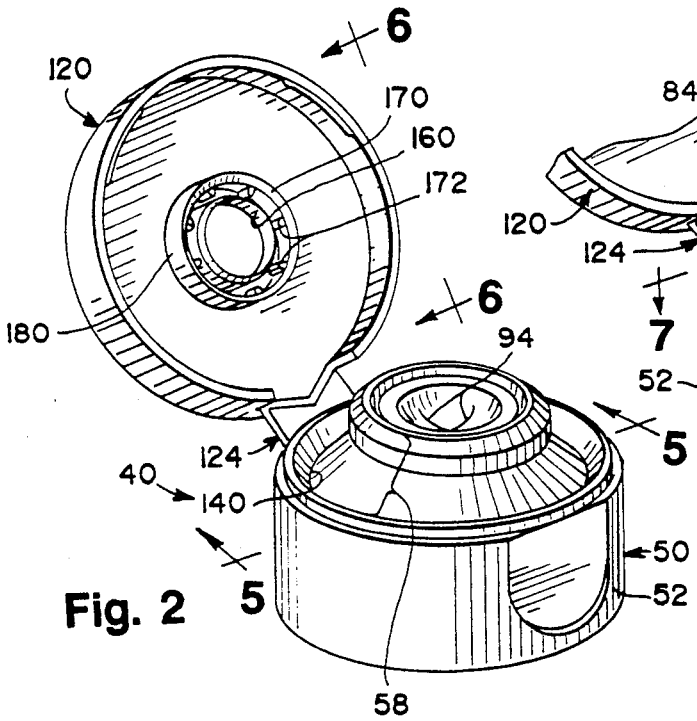
FIG. 2 is a perspective view of the closure in FIG. 1 shown with the lid in an open position.

As best illustrated in FIGS. 1-3, the closure 40 includes a housing, base, or body 50. In the illustrated embodiment, the housing or body 50 includes a peripheral wall in the form of a cylindrical skirt 52. The skirt 52 includes, on its interior surface, a conventional thread 54 or other suitable means (e.g., snap-fit bead (not illustrated)) for engaging suitable cooperating means, such as a thread 56 (FIG. 11), on the container neck 44 to releasably secure the body 5? to the container 42 (FIG. 11).

Figure 4:
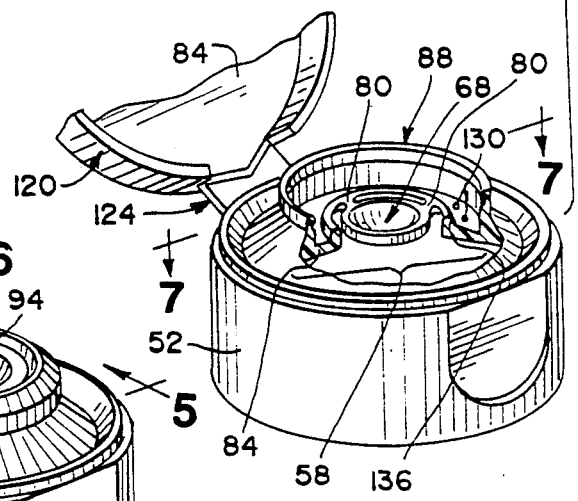
FIG. 4 is a greatly enlarged, fragmentary, cross-sectional view taken generally along the plane 4—4 in FIG. 1.
Figure 4:
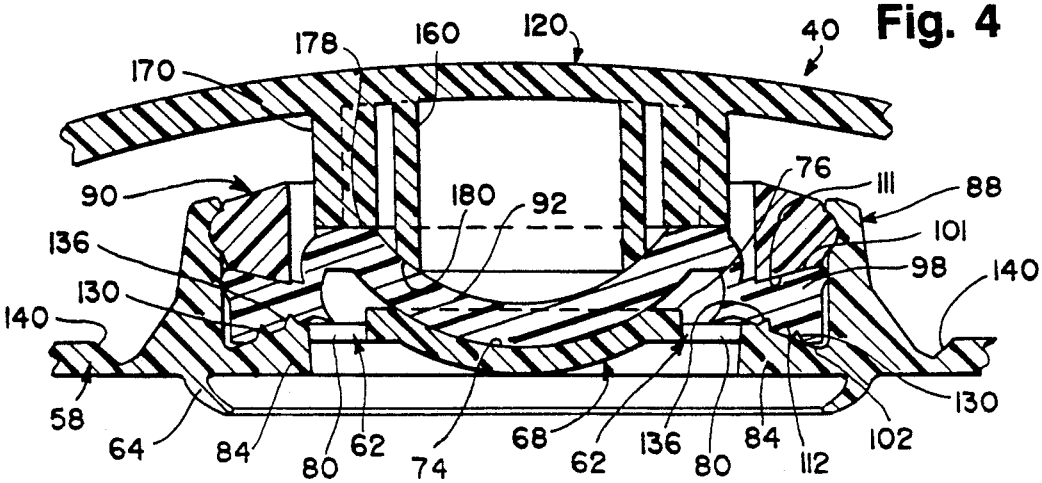
Figure 7:
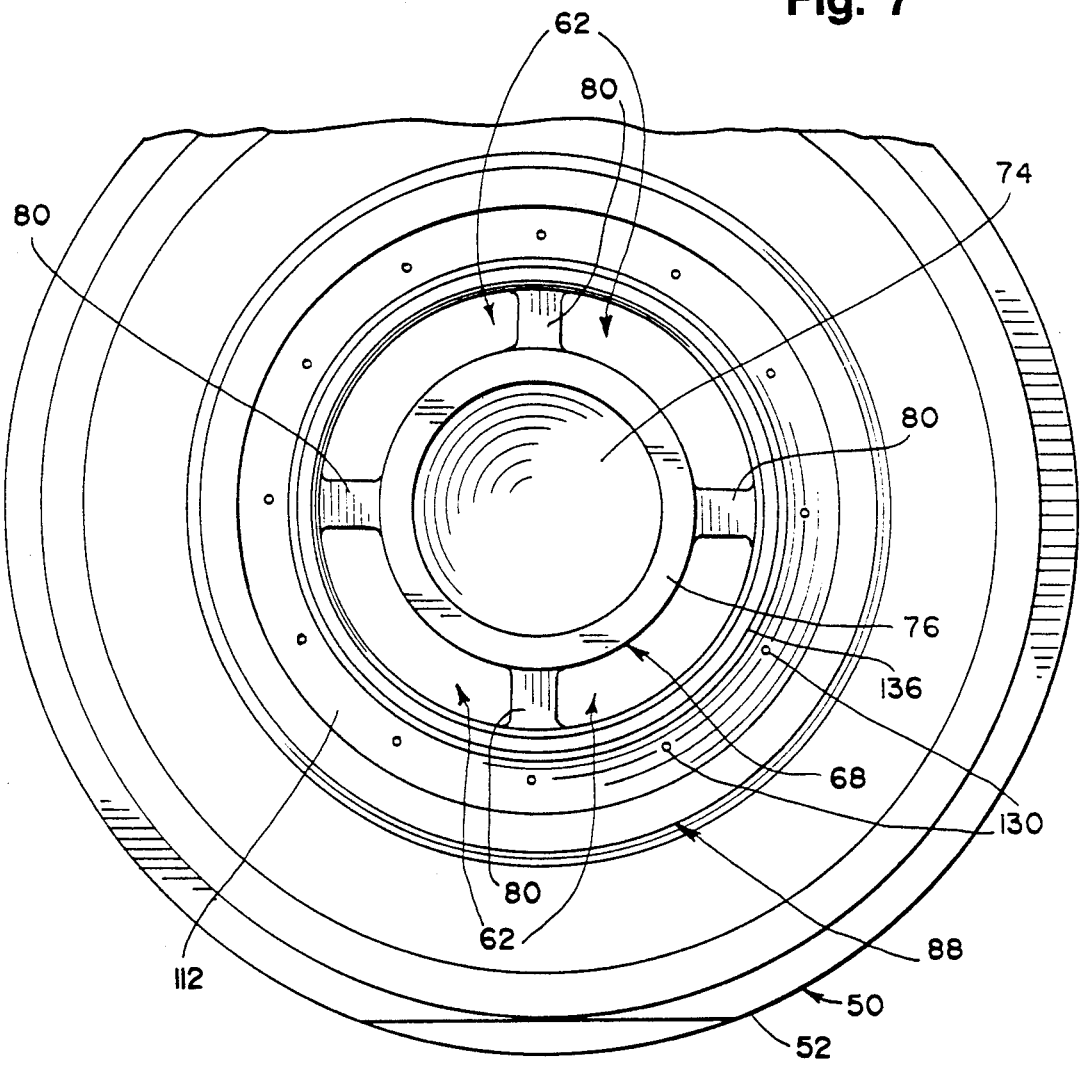
FIG. 7 is a greatly enlarged, fragmentary, plan view of the closure body taken generally along the plane 7—7 in FIG. 3.
Figure 9:
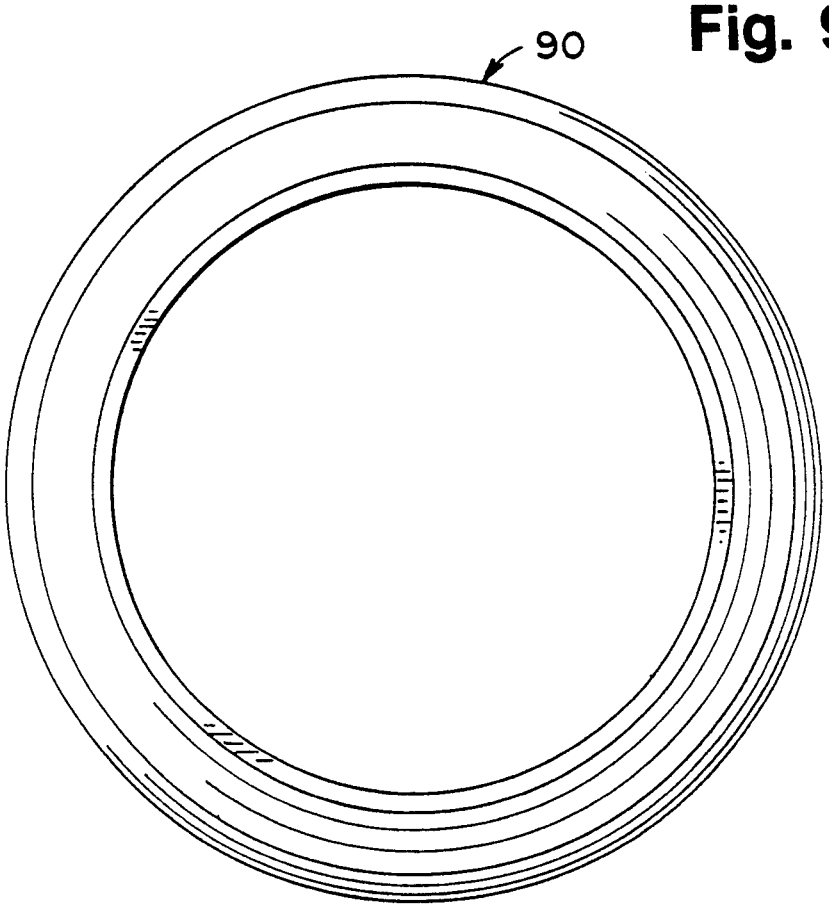
FIG. 9 is a plan view taken generally along the plane 9—9 in FIG. 8.
Figure 8:
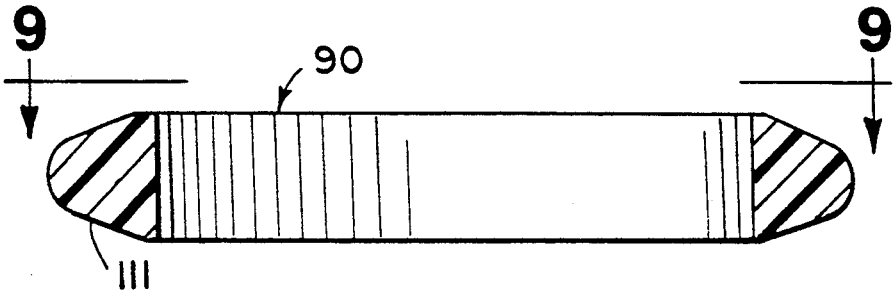
FIG. 8 is a greatly enlarged, cross-sectional view of the inset ring taken generally along the plane 8—8 in FIG. 3.

In the first embodiment illustrated in FIGS. 1-9 and 11, the body 50 includes a top wall 58 (FIGS. 2, 4, 5, 7, and 11) which defines a divided dispensing passage 62 as best illustrated in FIGS. 4, 5 and 7. The dispensing passage 62 establishes communication between the container interior and exterior through the container opening defined by the container neck 44.

Figure 11:
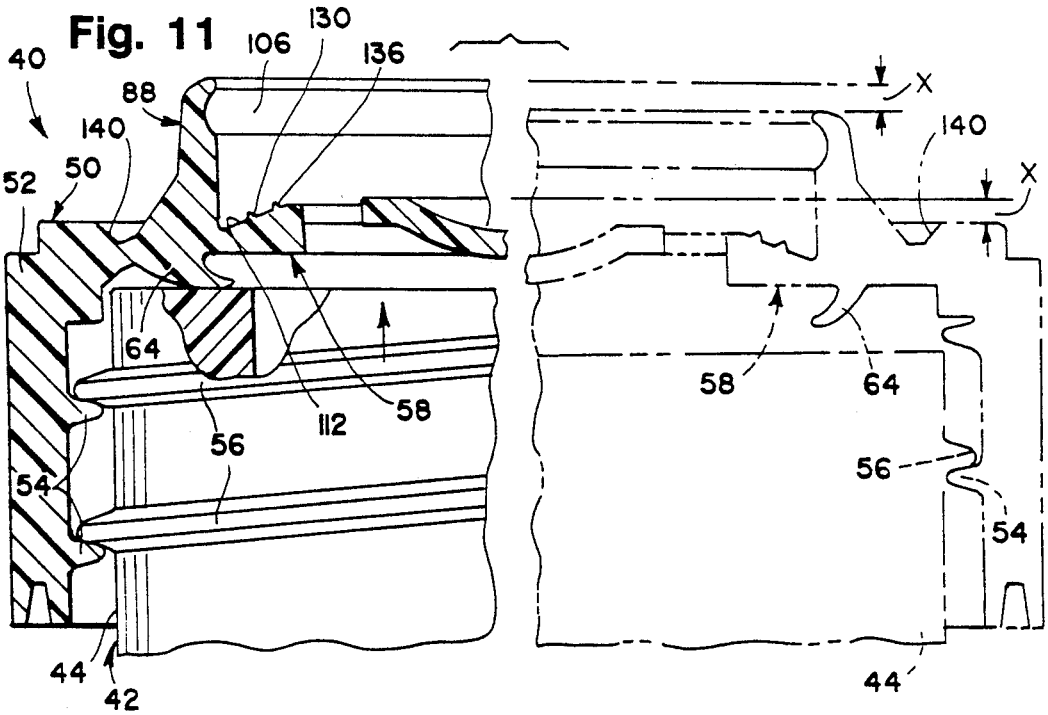
FIG. 11 is a cross-sectional view similar to FIG. 5, but with the valve removed, and the right-hand side of FIG. 11 illustrates, in phantom lines, the orientation of the closure before it is fully assembled on a container while the left-hand side of FIG. 11 illustrates, in solid lines, the final orientation of the closure when fully assembled on the container.

As best illustrated in FIG. 11, the body 50 includes an internal sealing ring 64 which projects downwardly from the underside of the top wall 58 and functions as a seal for protruding against or into the container neck 44 for engaging a peripheral surface of the neck 44 to effect a tight seal.

The closure body top wall 58 also includes a central support member 68 within the dispensing aperture 62 for supporting a dispensing valve 70 as described in more detail hereinafter.

The support member 68 has an upwardly facing concave surface 74 (FIGS. 5 and 7) which is surrounded by a flat, annular, peripheral surface 76. The support member 68 is maintained in position within the dispensing passage 62 by radially oriented arms 80 (FIG. 7) which extend from an annular seat or valve clamping member 84 (FIGS. 3 and 4).

The upwardly facing surface of the seat or clamping member 84 may be characterized as a seating surface or clamping surface 112 for engaging the valve 70 as will be described in detail hereinafter.

The closure body top wall 58 also defines a receiving means, such as an upwardly projecting, generally cylindrical, collar 88, for receiving the valve 70 and a retaining ring 90.

As illustrated in FIGS. 3 and 5, the valve 70 includes a flexible central wall 92 which is disposed across at least a portion of the dispensing passage in the body 50. The valve central wall 92 defines at least one normally closed dispensing slit 94. Preferably, two such slits 94 are disposed at intersecting right angles to form a cross shape. Each slit 94 extends completely through the thickness of the central wall 92.

The valve central wall on 92 is surrounded by generally cylindrical portion 96 from which extends a flange 98. In the preferred form illustrated in the first embodiment of the closure shown in FIGS. 1-9 and 11, the valve flange 98 has a cross-sectional shape as viewed in FIG. 5 which may be characterized as a "dovetail" shape.

When the valve 70 is disposed in the closure body 50 in the dispensing passage 62, the valve peripheral flange 98 is oriented to define a central plane 100 (FIG. 5) that is generally transverse to the discharge passage 62. The thickness of the flange normal to the plane is greater at the peripheral radial edge of the flange than inwardly thereof The thickness of the valve flange 98 may also be characterized as decreasing with increasing distance from the flange peripheral edge. The flange 98 defines first and second engagement surfaces 101 and 102 which are symmetrically oriented on opposite sides of the central plane.

The insert ring 90 is adapted to be disposed in the body collar 88 by means of a snap-fit engagement as illustrated in FIG. 5. To this end, the collar 88 defines an annular channel or recess 106 for receiving the ring 90. The ring 90 has a generally frustoconical configuration in cross-section as illustrated in FIG. 5, and the ring is symmetrical about a central plane perpendicular to the ring axis. Thus, the ring 90 may be mounted in the closure body collar 88 without regard to a particular azimuthal orientation and without regard to a particular upside down/right side up orientation.

When the insert ring 90 is mounted in the collar 88 over the valve flange 98 as illustrated in FIG. 5, the valve 70 is effectively retained in the closure body 50. The first engagement surface 101 of the valve flange 98 is clamped by the insert ring 90, and the insert ring 90 may be defined as a first clamping member having a first clamping surface 111 (FIG. 5) for contacting the valve flange surface 101.

The first clamping surface 111 is spaced from the valve body second clamping surface 112. Both clamping surfaces 111 and 112 are symmetrically arranged on opposite sides of the valve flange central plane 100 (FIG. 5). The spacing between the clamping surfaces 111 and 112 is less at a location adjacent the dispensing passage than at a location outwardly therefrom. That is, the spacing between the clamping surfaces increases with increasing distance from the dispensing passage.

Preferably, the surface profile of each clamping surface 111 and 112 generally conforms to the surface profile of the adjacent valve flange surface 101 and 102, respectively.

Preferably, the valve flange engagement surfaces 101 and 102 diverge in a direction away from the dispensing passage in a uniform manner, such as at the constant taper angle illustrated. Similarly, the spaced-apart clamping surfaces 111 and 112 also preferably diverge in a direction away from the dispensing passage in a uniform manner, such as at the constant taper angle illustrated. Preferably, and as illustrated in FIG. 5, the first clamping surface 111 on the retaining ring 90 has a frustoconical configuration, and the second clamping surface 112 on the closure body seat 84 also has a frustoconical configuration.

The novel closure illustrated in FIGS. 1-9 and 11 provides a clamping arrangement which securely holds the valve 70 in the closure body without requiring special internal support structures or bearing members adjacent the interior surface of the valve cylindrical portion 96. This permits the region adjacent the interior surface of the cylindrical portion 96 to be substantially open, free, and clear so as to minimize any restriction on the flow of the container contents through the passage 62.

The valve 70 functions in a well-known manner. When the container 42 (FIG. 11) is subjected to external forces, as when the container is squeezed to dispense the contents, the fluid material in the container is forced up against the valve 70 to temporarily deform the valve central portion 92 whereby the fluid material is discharged from the container through the slits 94. When the application of external pressure on the container is terminated, the inherent resilience of the valve material causes the valve to return to its normal, unstressed, closed orientation. Flexible, self-sealing valves of this type are well-known in the art. For example, see U.S. Pat. Nos. 1,607,993, 1,825,553, 2,802,607, 2,937,795 and 3,257,046.

The valve 70 may be fabricated from thermoplastic materials, such as polypropylene, polyethylene, copolyester elastomers, polyurethane, various styrenes, and chlorinated olefins. It is also contemplated that other materials may be used, such as thermoset materials, including silicone, natural rubber, and ethylene.

The closure may be provided with a lid 120. The lid 120 may be a separate, unconnected component which may be placed on, and removed from, the closure body 50. Preferably, the lid 120 is mounted to an edge of the closure body 50 as illustrated in FIG. 2. The lid is adapted to be pivoted between (1) a closed position (FIG. 1) over the closure top wall 58 and valve 70 and (2) an open position spaced away from the top wall 58 and valve 70 (FIG. 2).

In the preferred embodiment, the lid 120 is connected to the closure body 50 by suitable means, such as a snap-action hinge 124 as illustrated in FIG. 2.

Such a snap-action hinge 124 is formed integrally with the closure housing 50 and lid 120. The illustrated snap-action hinge 124 is a conventional type described in U.S. Pat. No. 4,403,712.

Preferably, the lid 120 and closure body are molded as a unitary structure from suitable thermoplastic materials, such as polypropylene or polyethylene.

When the closure body is molded from thermoplastic materials, the provision of the flat annular surface 76 around the concave support member surface 74 aids in the molding process. This eliminates having to mold an acute angle at the peripheral edge of the concave surface 74. Such a sharp angle is difficult to mold and is more likely to break.

The use of the separate, snap-fit retaining ring 90 accommodates the manufacture of the closure 40 and accommodates assembly of the components. In some applications, it may be desireable to hold the retaining ring 90 in a place in the closure body 50 by additional or other means, such as sonic welding, adhesive bonding, chemically fused bonding, or friction welding bonding.

In any case, it is preferable to provide a reduced spacing between the ring 90 and the closure body seat 84 inwardly from the peripheral edge of the valve flange 98. This provides a reduced volume region and requires substantially increased forces for valve removal.

The valve retention capability of the closure can be increased even further by providing at least one projecting protrusion on one of the clamping surfaces. For example, in the preferred embodiment illustrated in FIG. 1-9 and 11, projecting protrusions in the form of teeth or spikes 130 are circumferentially spaced-apart on the closure body seat clamping surface 112. Additionally, the clamping surface 112 includes a stepped ring or ridge of material 136. The protrusions, such as teeth-like projections, spikes, and rings, increase the retaining force because they become embedded in the valve flange material or otherwise deform the valve flange material If desired, such protrusions could be additionally or alternatively provided on the clamping surface 111 that is defined by the retaining ring 90.

When a closure is applied to a container (as illustrated in FIG. 11), there is a potential for distorting the closure and loosening the clamped valve 70. This potential problem is illustrated in FIG. 10 for a closure 40' that does not include a special compensating structure provided by a preferred embodiment of the present invention.

Figure 10:
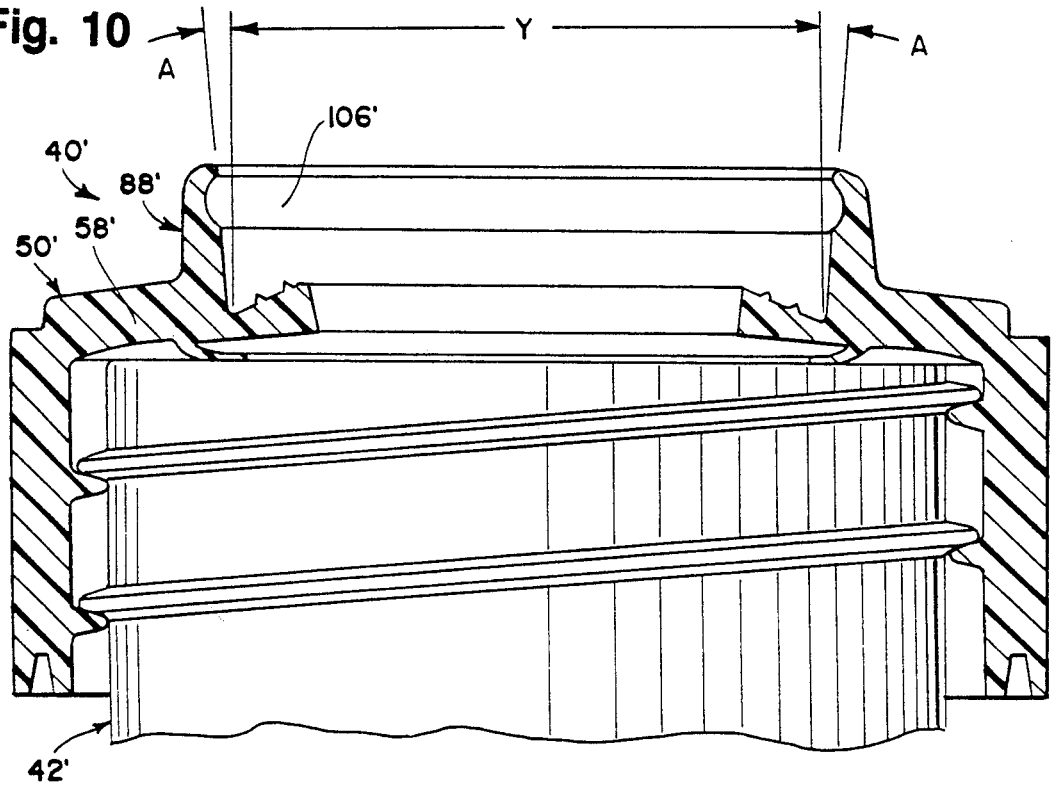
FIG. 10 is a cross-sectional view similar to FIG. 5, but showing a defective design of a closure body without a valve and retaining ring.

In particular, with reference to FIG. 10, the closure 40' is shown with the valve and retaining ring removed from the closure body 50' which is threadingly engaged with a container 42'. As the closure body 50' engages the top end surface of the neck of the container 42', the closure body top wall 58' begins to be pushed upwardly so as to bow upwardly or "dome".

Because the closure top wall 58' is connected about its outer periphery to the side wall or skirt of the closure body 50', the top wall 58' moves upwardly a greater amount at locations radially inwardly from the periphery of the closure body than it does at the outer periphery of the closure body. This "doming" phenomenon causes the collar 88' to be expanded radially outwardly as indicated by the angle A in FIG. 10. This results in the diameter of the collar 88' increasing at the retaining ring receiving recess 106'. As a consequence, the retaining ring (not illustrated) may become loose and may even be forced out of the collar 88'. This would permit the valve (not illustrated) to be expelled from the closure.

A feature of the preferred embodiment of the present invention functions to overcome the "doming" tendency of the closure body 50 when it is applied to a container 42 as illustrated in FIG. 11. Specifically, an annular channel 140 is defined in the top wall 58 radially outwardly of the collar 88. Preferably, the channel 140 has a V-shaped cross-section and opens upwardly around the collar 88 to define a reduced thickness section in the top wall. This accommodates elongation of the section when the top Wall 58 is engaged by the end of the container neck.

The right-hand side of FIG. 11 illustrates (in phantom) the position of the container top wall 58 prior to engagement of the top wall 58 by the top of the container neck 44. In this position, before the closure 40 is fully threaded onto the container neck 44, the reduced cross-sectional thickness of the top wall 58 below the annular channel 140 is substantially unstressed and undeformed.

However, when the upper end of the container neck 44 engages the closure top wall (at seal 64 on the top wall 58) as illustrated in solid lines in the left-hand side of FIG. 11, the portion of the top wall 58 radially inwardly of the annular channel 140 is moved upwardly with considerably less "doming" because the reduced thickness section below the channel 140 can deform and elongate. This acts as a flexure means or hinge means to some extent.

The portion of the top wall 58 radially inwardly of the channel 140 is thus pushed up with considerably less distortion, and the collar 88 tends to remain in the original, unstressed, vertical orientation. This means that the diameter of the ring receiving recess 106 of the collar 88 remains substantially unchanged as the closure is tightly engaged with the container neck. As a result, the valve 70 will remain properly retained within the closure 40.

Another feature of the preferred embodiment of the closure of the present invention prevents inadvertent discharge or leakage of the container contents out of the closure. This feature relies on a unique cooperation between the closure lid 120, the valve 70, and the support member 68.

Specifically, the closure lid 120, as best illustrated in FIGS. 2 and 6, includes an annular sealing collar 160 for engaging the valve central wall 92 when the lid 120 is closed as illustrated in FIG. 4. The collar 160 forces the valve central wall 92 against the closure body support member 68 so as to seal the valve closed around the slits 94 (FIGS. 2 and 3).

Preferably, the lid 120 also includes an outer annular sleeve 170 that is shorter than the annular sealing collar 160. The lid 120 further includes lugs 172 which are circumferentially spaced apart around the inner periphery of the lid sleeve 170. The lugs 172 are unitary with the lid sleeve 170, and each lug 172 has an end surface that is coplaner with the sleeve end surface.

The lugs 172 and sleeve 170 function to force a peripheral, annular flat surface 178 of the valve 70 downwardly when the lid is closed (FIG. 4). This helps to deform the valve central wall 92 downwardly to conform with the support member 68 so that the valve slits 94 are effectively sealed within the annular sealing collar 160.

Further, to ensure that the sealing collar 160 effectively engages the valve central wall 92, the sealing collar 160 preferably has a frustoconical end surface 180. The frustoconical end surface 180 defines an angle that is equal to the angle of a line tangent to the support member concave surface 74 at a point axially aligned with a selected point on the end surface 180 when the lid is closed.

When the closure lid 120 is open, the valve 70, owing to its inherent resiliency, returns to its original, unstressed configuration (FIG. 5). In that configuration, the valve central wall 92 is spaced upwardly from the support member concave surface 74, and the valve cylindrical portion 96 assumes its original, unstressed cylindrical configuration. In this configuration, the contents of the container may pass up through the dispensing passage 62 and out through the valve 92 when the pressure of the liquid is sufficient to overcome the resilient closure forces of the valve 70.

FIGS. 12–30 illustrate other optional features of the present invention which may be employed in place of some of the previously described structures. FIGS. 12–14, 17, and 20 illustrate embodiments in which various, self-sealing, flanged valves are employed. The flanged valves are generally illustrated in simplified cross-sectional views to show the overall cross-sectional configurations. The particular valve internal configurations, wall thicknesses, curvatures of the valve central wall portions, etc. may be of any suitable design consistent with the valve mounting flange structure that is illustrated.

Figure 12:
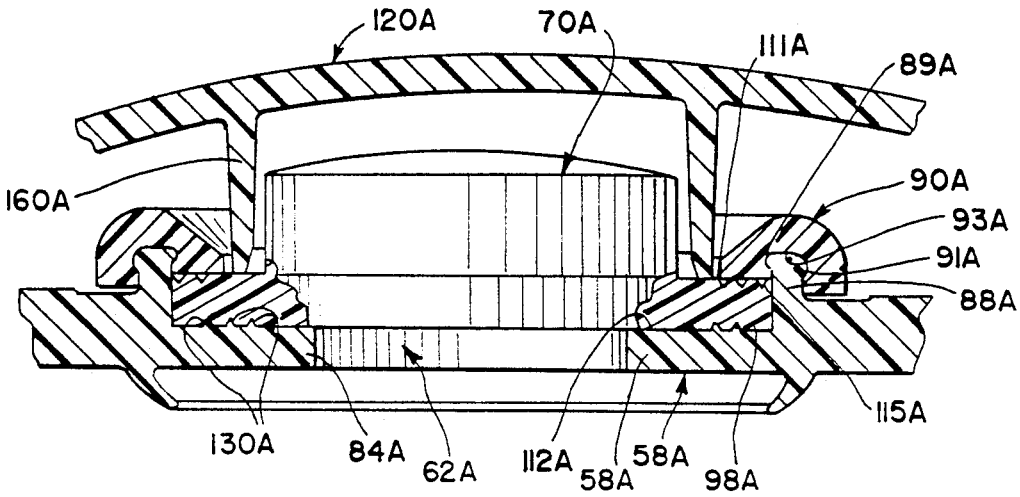
FIG. 12 is a view similar to FIG. 4, but showing a second embodiment of the closure.

FIG. 12 illustrates a second embodiment of the invention wherein the closure body includes a top wall 58A defining the dispensing passage 62A. No valve support member, such as valve support member 68 shown in FIG. 3, is provided in this embodiment.

The closure body top wall 58A includes a generally cylindrical collar 88A for receiving a self-sealing valve 70A. The valve 70A includes a peripheral, generally planar, flange 98A which is seated on an upwardly facing surface 112A on the body clamping member or seat 84A. The clamping surface 112A preferably includes protrusions 130A, and these protrusions 130A may be spikes, teeth, or annular rings having a sharp edge for gripping the valve flange 98A.

The upper end of the collar 88A is provided with a radially inwardly extending bead 89A and with a radially outwardly extending bead 91A. A retaining ring 90A is provided with a channel 93A for mating with the collar beads 89A and 91A to form a snap-fit engagement between the retaining ring 90A and the collar 88A.

A radially inwardly extending portion of the ring 90A functions as a clamping member defining a downwardly facing clamping surface 111A. The clamping surface 111A preferably includes protrusions 115A which may be in the form of teeth, spikes or sharp annular rings for engaging the valve flange 98A.

A separate or attached lid 120A is provided, if desired, for covering the valve 70A as well as the retaining ring 90A and closure body top wall 58A. The lid 120A has an annular sealing ring or spud 160A for sealing against the valve flange 98A.

Figure 13:
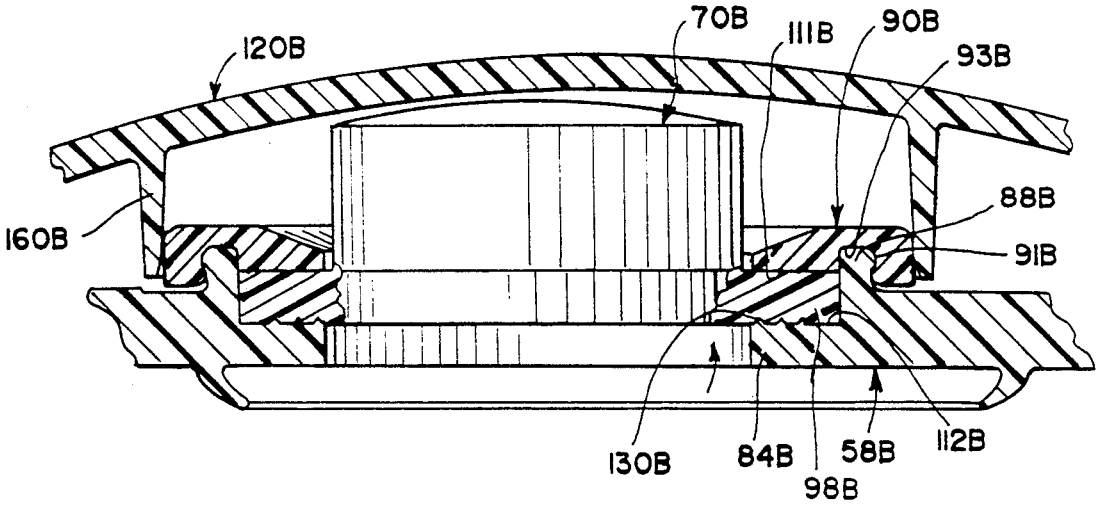
FIG. 13 is a view similar to FIG. 12, but showing a third embodiment of the closure.

A third embodiment of the closure is illustrated in FIG. 13. The closure body has a top wall 58B defining a dispensing passage 62B and defining an upstanding, generally cylindrical collar 88B. The body top wall 58B has a clamping member 84B with a clamping surface 112B defining protrusions 30B for engaging a flange 98B of a self-sealing valve 70B. The upper end of the collar 88B defines a radially outwardly projecting bead 91B.

A retaining ring 90B is provided with a channel 93B for forming a snap-fit engagement with the collar 88B. The retaining ring 90B has a radially inwardly projecting clamping member defining a downwardly facing clamping surface 111B.

A cover or lid 120B can be provided as a separate component or may be provided as a component that is hingedly attached to the closure body. The lid 120B has an annular sealing ring or spud 160B for sealing against the exterior peripheral surface of the retainer ring 90B.

A fourth embodiment illustrated in FIGS. 14–16 employs an annular segment as a retaining ring 90C. The segment ring 90C is sufficiently flexible to permit it to be inserted past a bead 107C defined by the closure body top wall 58C around the dispensing passage 62C. The ring 90C is sufficiently resilient to remain engaged above the bead 107C when subjected to downwardly directed reaction forces.

The closure body top wall 58C has a generally cylindrical collar 88C with a radially inwardly projecting clamping member 84C.

A self-sealing valve 70C is provided with a mounting flange 98C which is clamped between the ring 90C and the clamping member 84C. The clamping member 84C defines a seating surface 112C which functions as a clamping surface, and the ring 90C defines a clamping surface 111C. The clamping surface 111C of the ring 90C includes three circular arc gripping rings 115C. The clamping surface 112C includes a protrusion 130C which may be in the form of a gripping ring, teeth, or spikes.

Although not illustrated, the closure may include a lid similar to the lid 120B illustrated in FIG. 13.

A fifth embodiment is illustrated in FIG. 17 wherein a self-sealing valve 70D is provided with a peripheral flange 98D. The flange 98D has an axial cross-section in the shape of a diverging dovetail configuration. The valve flange 98D is carried on the valve closure body top wall 58D in a cylindrical collar 88D. The bottom of the flange 98D is disposed on an inwardly projecting lower clamping member 84D which defines a frustoconical seating and clamping surface 112D.

A retaining ring 90D is provided with a channel 93D for receiving the cylindrical collar 88D. The retaining ring 90D may be sonically welded to the collar 88D. The retaining ring 90D includes an inwardly extending clamping member having a downwardly facing frostoconical clamping surface 111D. The clamping surfaces 84D and 111D diverge with increasing radial distance from a dispensing passage 62D defined by the body top wall 58D.

A lid 120D may be provided if desired as a separate or integral part of the closure.

Further, the clamping surfaces 111D and 112D may be provided with protrusions, such as teeth, spikes, or rings for gripping the valve flange 98D.

A sixth embodiment of a closure body is illustrated in FIGS. 18-21 wherein the closure body includes a top wall 58E defining an interrupted dispensing passage 62E (FIG. 19). The top wall 58E includes a central support member 68E which is maintained in the dispensing passage 62E by arms 80E.

The closure body top wall 58E includes a lower clamping member 84E defining an frustoconical clamping surface 112D that functions as the lower seat for a peripheral mounting flange 98E of a self-sealing valve 70E.

The closure body top wall 58E includes a cylindrical collar 88E having an outwardly directed bead 91E. A retaining ring 90E (FIG. 20) is provided with a channel 93E for conforming to the collar 88E and being mounted thereon in a snap-fit engagement to retain the valve 70E in the closure body. The body top wall 58E also defines an annular channel 97E (FIGS. 18 and 20) for receiving the lower portion of the wall of the ring 90E. This prevents the ring 90E from being pried off with a fingernail or tool.

Figure 20:
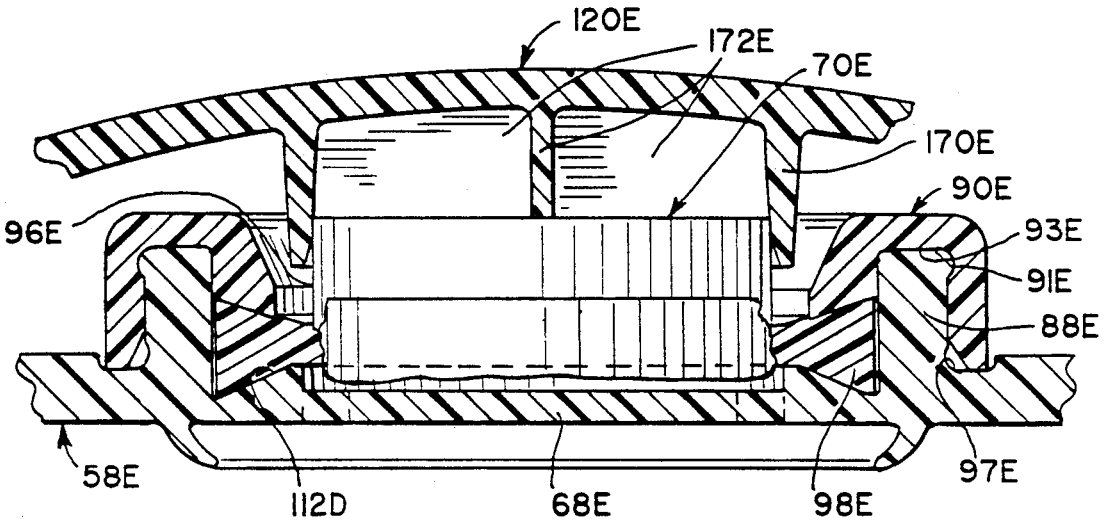
FIG. 20 is a view similar to FIG. 18, but showing the closure body assembled with the valve, retaining ring, and closure lid.
Figure 21:
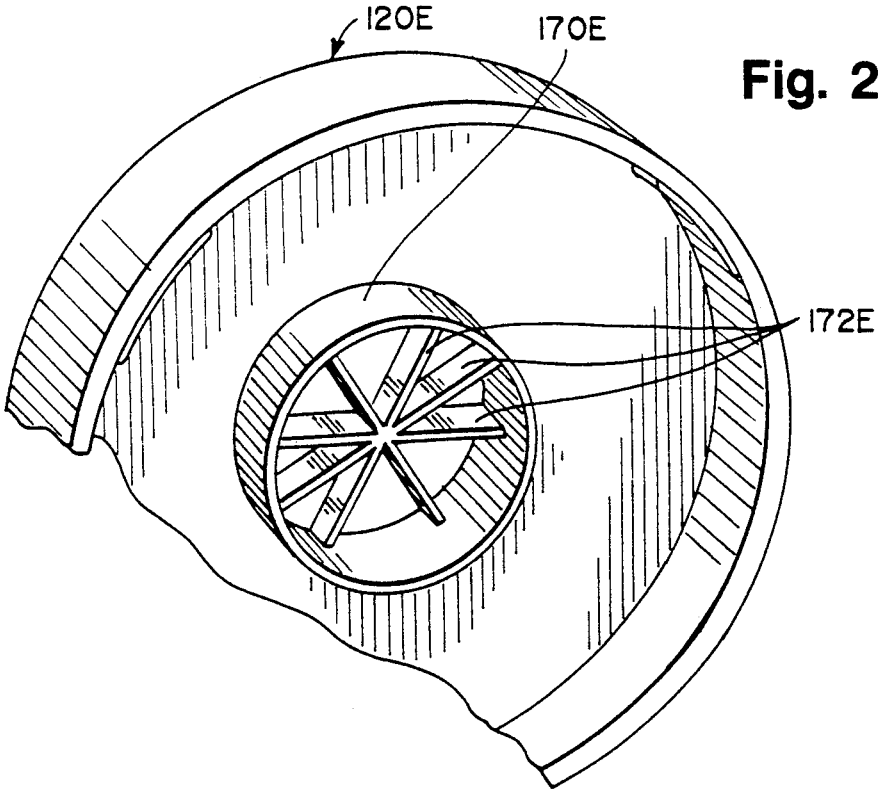
FIG. 21 is a perspective view of the interior of the lid of the closure illustrated in FIG. 20.

A novel lid 120E is provided for covering the closure body top wall 58E, valve 70E, and retaining ring 90E. As illustrated in FIGS. 20 and 21, the lid 120E includes a sleeve 170E for engaging the exterior of a cylindrical portion 96E of the valve 70E. Further, the lid 120E includes a plurality of downwardly extending lugs 172E which define a spoke-like configuration and which are adapted to engage the top surface of the valve 70E.

The lid 120E may be a separate, removeable component or may be attached to the closure body by a suitable hinge structure. In any event, when the lid 120E is properly closed over the valve 70E (FIG. 20), the side of the valve cylindrical portion 96E is sealed by the lid sleeve 170E, and the upper surface of the valve 70E is restrained against outward deformation by the lugs 172E.

The self-sealing valve 70E includes a conventional dispensing structure, such as a slit or slits (not illustrated). However, the opening of the valve in the outward direction will be substantially restrained by the lid lugs 172E. Further, any leakage through the valve 70E will be retained within the lid by sleeve 170E.

When the lid 120E is closed over the valve 70E, the bottom of the valve 70E is spaced above the closure body support member 68E. When lid 120E is removed, and the closure is used for dispensing, the support member 68E prevents an inadvertent impact on the valve 70E from forcing the valve 70E too far inwardly into the closure. Further, depending upon the exact configuration of the self-sealing valve 70E that is selected, the valve 70E may also be maintained in a downwardly deformed position against the support member 68E when the lid 120E is in the closed position. In that situation, the closed position deformation of the valve 70E would be analogous to that which occurs with respect to the embodiment of the closure 40 illustrated in FIG. 4 and discussed above in detail.

Figure 22:
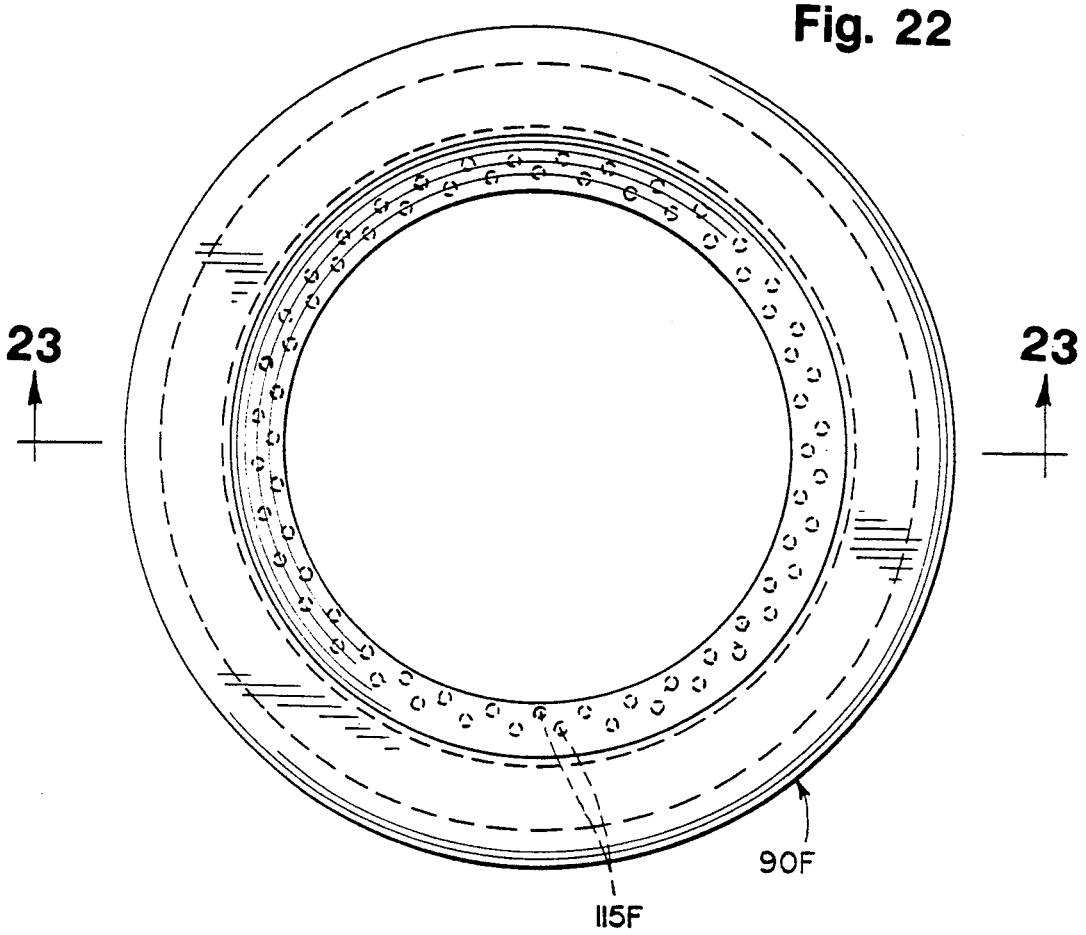
FIG. 22 is a plan view of the underside of another embodiment of an insert ring that may be incorporated in an embodiment of the closure of the present invention.
Figure 23:
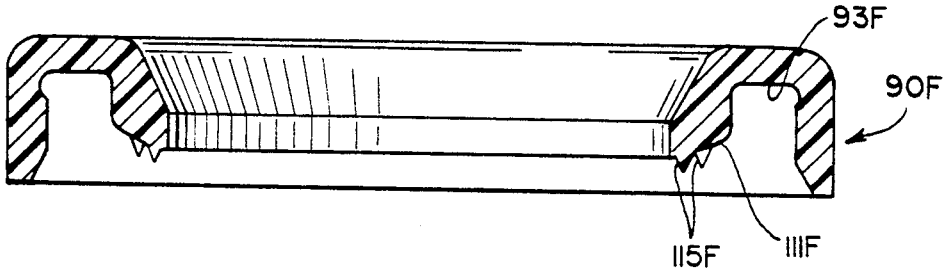
FIG. 23 is a cross-sectional view taken generally along the plane 23—23 in FIG. 22.

An alternate form of a retaining ring that can be employed in place of the retaining ring 90E in FIG. 20 is illustrated in FIGS. 22 and 23 and is designated therein generally by the reference numeral 90F. The ring 90F includes a channel 93F for accommodating the snap-fit engagement with the closure body collar 88E. The retaining ring 90F further includes a radially inwardly extending clamping member defining a downwardly directed clamping surface 111F. The clamping surface 111F includes a plurality of teeth or spikes 115F. As best illustrated in FIG. 22, the spikes 115F are arranged in two concentric circles. In each circle, the spikes 115F are circumferentially spaced apart. The spikes 115F in the outer circle are offset relative to the spikes 115F in the inner circle.

Figure 24:
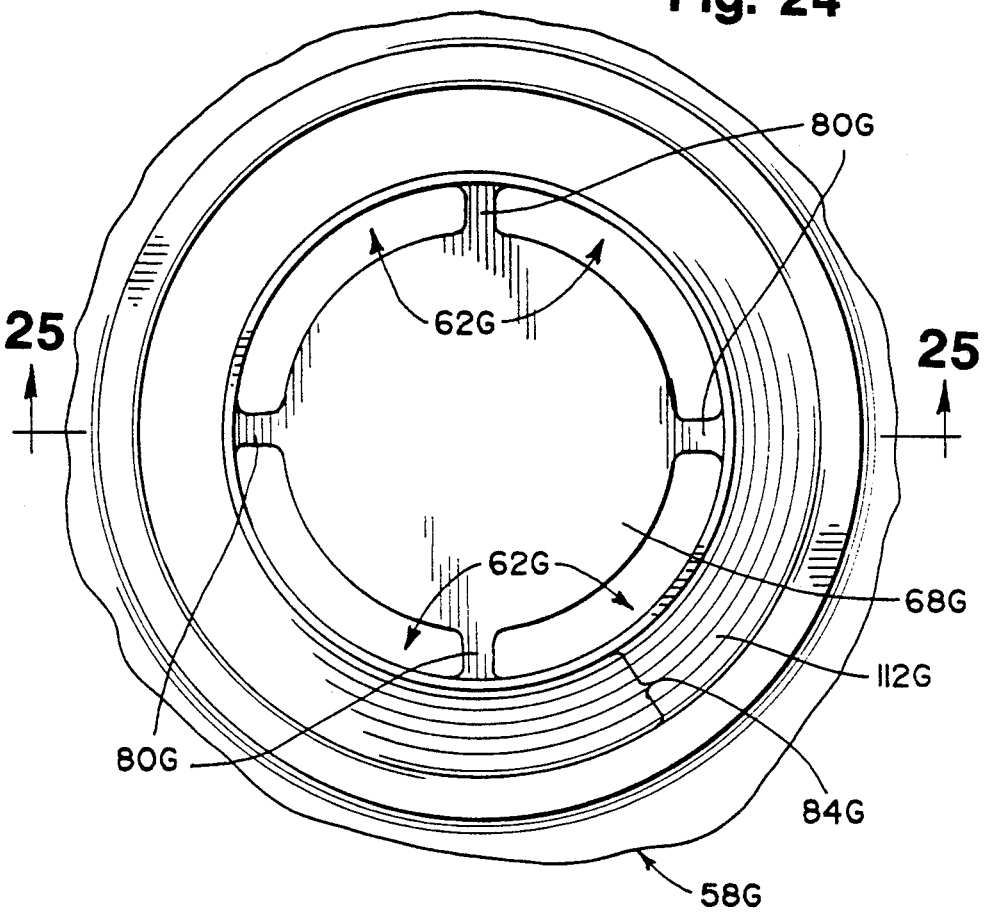
FIG. 24 is a fragmentary, plan view of the body of a seventh embodiment of the closure of the present invention shown with the valve and lid removed to illustrate interior details.
Figure 25:
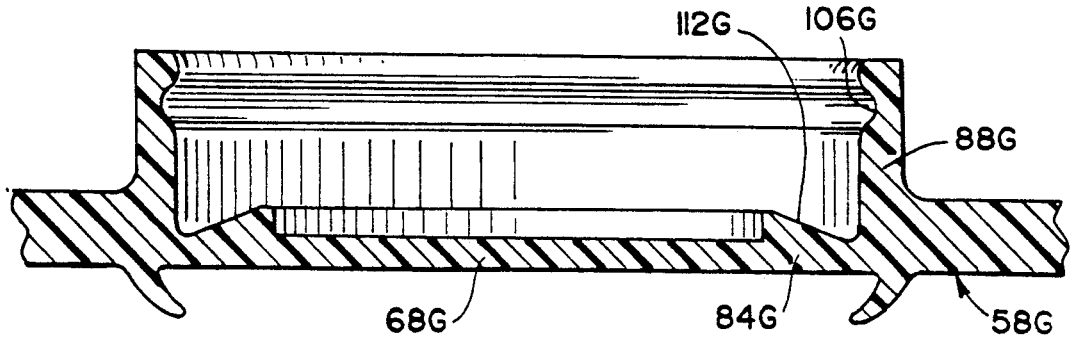
FIG. 25 is a fragmentary, cross-sectional view taken generally along the plane 25—25 in FIG. 24.

A seventh embodiment of a closure is illustrated in FIGS. 24 and 25 wherein the body top wall is designated generally by the reference numeral 58G. The top wall 58G is adapted to receive a suitable, self-sealing, flanged, dispensing valve (not illustrated), such as the valve 70E illustrated in FIG. 20.

The central portion of the top wall 58G is similar to the embodiment illustrated in FIG. 19 and includes an interrupted or divided dispensing passage 62G through which a liquid can be dispensed around a central support member 68G. The support member 68G is joined to a lower clamping member 84G by arms 80G. The lower clamping member 84G defines an upwardly facing clamping surface 112G for engaging the underside of the self-sealing valve flange (not illustrated).

The enclosure body top wall 58G includes a generally cylindrical collar 88G which is adapted to receive the self-sealing valve. The collar 88G defines an inwardly open channel 106G for receiving a suitable retaining ring.

Figure 29:
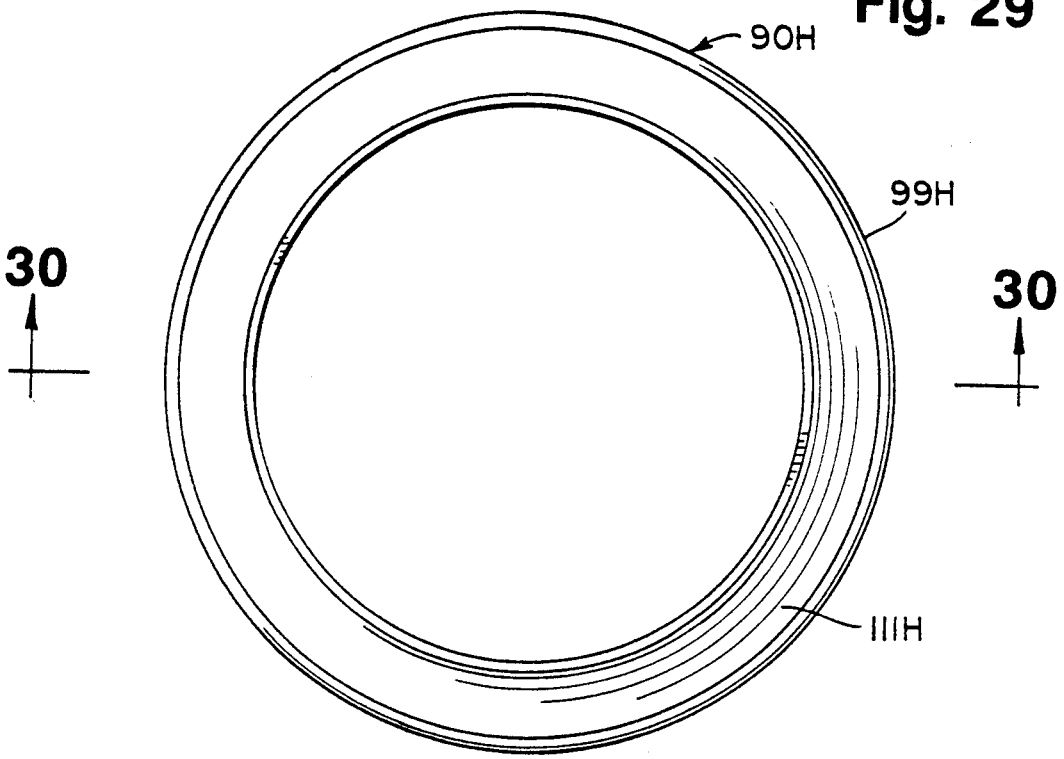
FIG. 29 is a plan view of another embodiment of an insert ring which may be employed in the closure body illustrated in FIGS. 24 and 25.
Figure 30:
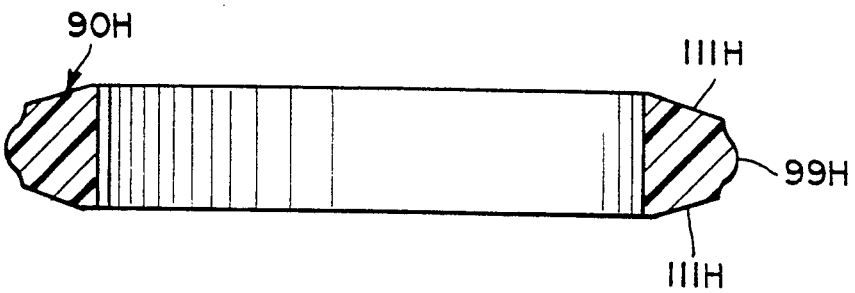
FIG. 30 is a cross-sectional view taken generally along the plane 30—30 in FIG. 29.

A first alternate form of a suitable retaining ring 90G is illustrated in FIGS. 27-28, and a second alternate form of a retaining ring 90H is illustrated in FIGS. 29 and 30. The ring 90G has a plurality of circumferentially spaced-apart stiffening lugs 97G on the inside of the ring. The outside of the ring 90G includes a bead 99G for being received in the closure body collar channel 106G in a snap-fit engagement.

The retaining ring 90G has a lower, frustoconical, clamping surface 111G. Spikes or teeth 115G project downwardly from the surface 111G for engaging the valve flange. As best illustrated in FIG. 28, the teeth 115G are in a staggered relationship. This relationship may be alternatively described as defining two, concentric circles of spaced-apart spikes. The concentric circles of spikes are azimuthally oriented so that each spike on the inner circle is equidistant from two adjacent spikes on the outer circle.

The alternate form of the ring 90H illustrated in FIGS. 29 and 30 is symmetrical about a central plane passing through the ring and oriented perpendicular to the longitudinal axis of the ring. Because of this, either side of the ring may be positioned to engage the valve flange. Each side of the ring defines a frustoconical surface 111H, and the peripheral edge of the ring defines a bead 99H for being received in the closure body collar recess 106G (FIG. 25) in a snap-fit engagement. The ring 90H does not have protrusions, such as spikes or retaining rings, but such protrusions could be provided if desired.

In all of the above discussed embodiments where it is a desired to provide protrusions on the clamping surfaces of the retaining ring and/or the closure body top wall seat, the protrusion may be provided in the form of an elongate member (e.g., tooth or spike) bent over near its base so as to extend generally radially outwardly relative to the dispensing passage and generally parallel to the engagement surface of the valve flange. With such an arrangement, forces tending to pull the valve flange inwardly and upwardly out of the closure body will cause the "bent over" spikes to engage the flange and be forced radially inwardly. This would tend to urge the spikes to pivot away from the "bent over" position toward a vertical position. This would increase the engagement between the spikes and the valve flange and contribute to increased reaction forces for retaining the valve flange.

The presently contemplated preferred embodiment of the closure of the present invention is illustrated in FIGS. 31-34 and is represented generally in those figures by reference numeral 40J. The closure 40J is adapted to be disposed on a container (not illustrated) which has a conventional mouth or opening formed by a neck or other suitable structure. The closure 40J may be fabricated from a thermoplastic material, or other materials, compatible with the container contents.

The closure 40J includes a housing, base, or body 50J. In the illustrated embodiment, the housing or body 50J includes a peripheral wall in the form of an oval skirt 52J.

Figure 34:
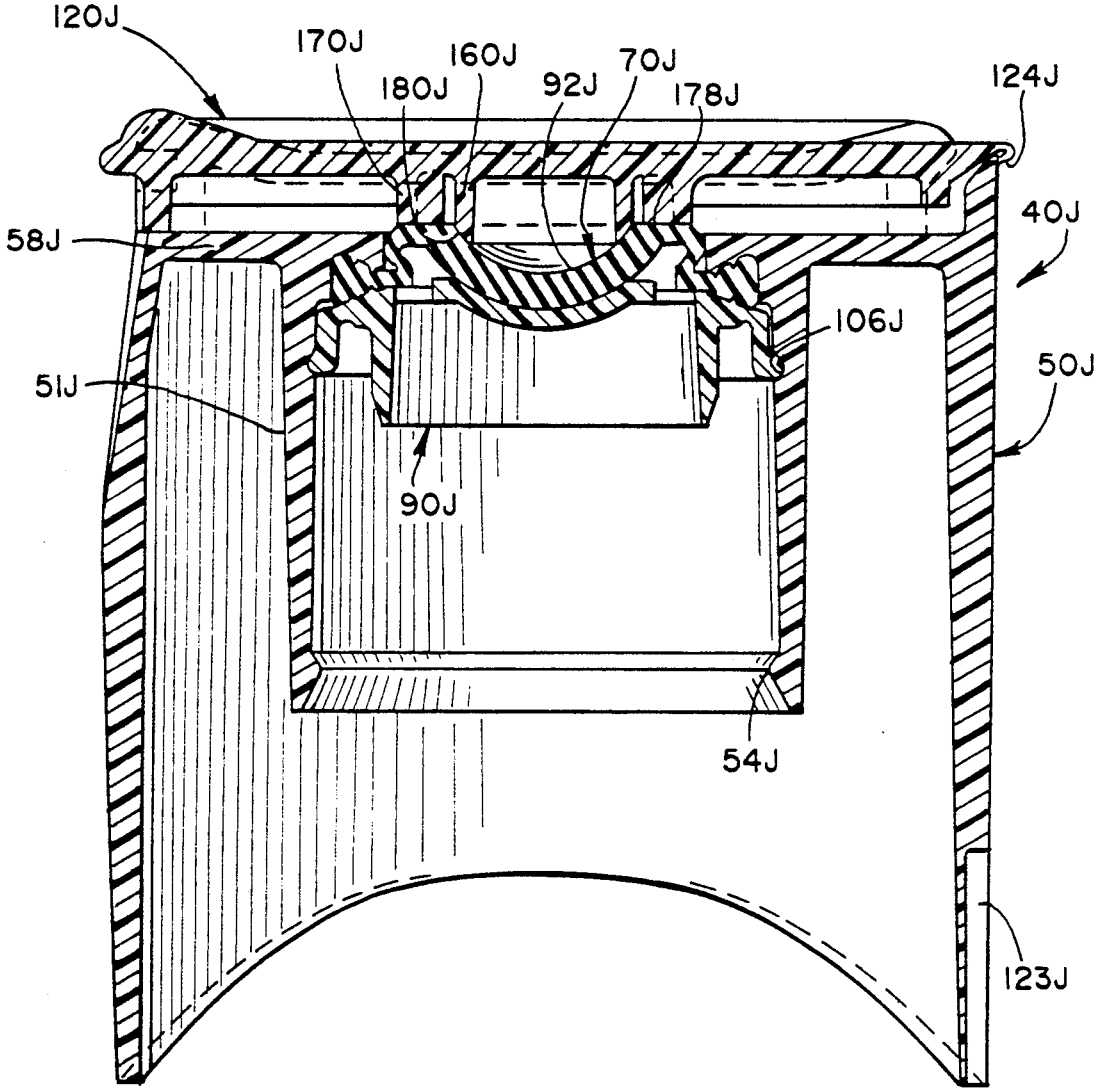
FIG. 34 is a view similar to FIG. 33 but showing the lid fully closed.

The body 50J includes a downwardly depending collar 51J (FIGS. 33 and 34). The interior surface of the collar 51J has a conventional snap-fit bead 54J or other suitable means (e.g., a thread (not illustrated)) for engaging suitable cooperating means, such as an annular groove (not illustrated) that is typically provided on the container neck to releasably secure the body 50J to the container.

The body 50J includes a top wall 58J (FIG. 31) which defines a dispensing passage 62J (FIG. 31). The dispensing passage 62J establishes communication between the container interior and exterior through the container opening defined by the container neck.

The closure body top wall 58J also includes a first clamping member in the form of an inner flange 59J around the dispensing aperture 62J for clamping a soft, resilient, dispensing valve 70J as described in more detail hereinafter. The first clamping member or flange 59J has a first, downwardly facing clamping surface 111J. The clamping surface 111J may be characterized as a seating surface and preferably includes protrusions in the form of sharp annular rings 115J. In a preferred embodiment, there are two concentric rings 115J of identical cross section which each have a projection height in the range of about 0.007 inch to about 0.012 inch. The transverse cross-sectional profile of each ring is a 30°-60°-90° triangle in which the 60° angle is defined at the outwardly projecting end of the ring.

As illustrated in FIGS. 31 and 33, the dispensing valve 70J is mounted in the closure body 50J. The valve 70J is substantially identical to the valve 70 discussed above with reference to the first embodiment illustrated in FIGS. 1-9 and 11. Specifically, the valve 70J includes a flexible central wall 92J which is disposed across at least a portion of the dispensing passage 62J in the body 50J. The valve central wall 92J defines at least one normally closed dispensing slit 94J. Preferably, two such slits 94J are disposed at intersecting right angles to form a cross shape. Each slit 94J extends completely through the thickness of the central wall 92J.

The valve central wall 92J is surrounded by generally cylindrical portion 96J from which extends a flange 98J. In the preferred form, the valve flange 98J has a cross-sectional shape, as viewed in FIG. 33A, which may be characterized as a "dovetail" shape.

When the valve 70J is disposed in the closure body 50J in the dispensing passage 62J, the valve peripheral flange 98J is oriented to define a central plane 100J (FIG. 33A) that is generally transverse to the discharge passage 62J. The thickness of the flange 98J normal to the plane is greater at the peripheral radial edge of the flange than inwardly thereof. The thickness of the valve flange 98J may also be characterized as decreasing with increasing distance from the flange peripheral edge. The flange 98J defines first and second engagement surfaces 101J and 102J which are symmetrically oriented on opposite sides of the central plane 100J. Preferably, the first and second engagement surfaces 101J and 102J are each oriented at about a 22° angle relative to the central plane 100J.

A second clamping member in the form of an insert retaining ring 90J is adapted to be disposed in the body collar 51J by means of a snap-fit engagement as illustrated in FIG. 33A. To this end, the collar 51J defines an annular channel or recess 106J for receiving the ring 90. The ring 90J includes a peripheral flange 99J which is shaped to be received in, and mate with, the collar annular channel 106J. To aid in assembly, the flange 99J is preferably somewhat resilient to facilitate insertion of the ring 90J into the closure body collar 51J.

The ring 90J includes a generally cylindrical, internal, sealing ring or collar 64J which projects downwardly from the underside of the ring 90J and functions as a seal for protruding against or into the neck of the container (not illustrated). The collar 64J engages a peripheral surface of the container neck to effect a tight seal.

The ring 90J has a clamping wall or member 84J (FIG. 33A) which extends between the outer flange 99J and the inner collar 64J. The upwardly facing surface of the wall or member 84J may be characterized as a seating surface or second clamping surface 112J for engaging the valve 70J as will be described in detail hereinafter.

Preferably, upwardly projecting protrusions in the form of teeth or spikes 130J are circumferentially spaced-apart in the clamping surface 112J. In the presently contemplated preferred embodiment, twelve such spikes 130J are equally spaced around the annular clamping surface 112J. Each spike has a height in the range of about 0.007 inch to about 0.012 inch.

Also, a ring 131J is preferably provided inwardly of the spikes 130J. The ring 131J preferably has the same cross-sectional configuration and cross-sectional dimensions as the rings 115J on the body first clamping surface 111J. In a presently contemplated product, the diameter of the inner ring 115J is about 0.562 inch, the diameter of the outer ring 115J is about 0.626 inch, the diameter of the second clamping surface ring 131J is about 0.559 inch, and the upwardly projecting teeth 130J are arranged in a circle having a diameter of about 0.623 inch.

The insert ring 90J is symmetrical around its vertical axis and may thus be mounted in the closure body collar 51J without regard to a particular azimuthal orientation. When the insert ring 90J is mounted in the collar 51J under the valve flange 98J as illustrated in FIG. 33A, the valve 70J is effectively retained in the closure body 50J. The first engagement surface 101J of the valve flange 98J is clamped by the closure body first clamping surface 111J. The second engagement surface 102J of the valve flange 98J is clamped by the second clamping surface 112J of the insert ring 90J.

The first clamping surface 111J is spaced from the second clamping surface 112J. Both clamping surfaces 111J and 112J are symmetrically arranged on opposite sides of the valve flange central plane 100J (FIG. 33A). The spacing between the clamping surfaces 111J and 112J is less at a location adjacent the dispensing passage than at a location outwardly therefrom. That is, the spacing between the clamping surfaces increases with increasing distance from the dispensing passage.

Preferably, the surface profile of each clamping surface 111J and 112J generally conforms to the surface profile of the adjacent valve flange engagement surfaces 101J and 102J, respectively. It is preferred that the valve flange engagement surfaces 101J and 102J diverge in a direction away from the dispensing passage in a uniform manner, such as at the constant taper angle illustrated (about 22° relative to the plane 100J for the presently contemplated preferred embodiment). Similarly, the spaced-apart clamping surfaces 111J and 112J also preferably diverge in a direction away from the dispensing passage in a uniform manner, such as at the constant taper angle illustrated (about 22° relative to the plane 100J for the presently contemplated preferred embodiment). Thus, as illustrated in FIG. 33A, the first clamping surface 111J and the second clamping surface 112J each have a frustoconical configuration.

The novel closure illustrated in FIGS. 31-34 provides a clamping arrangement which securely holds the valve 70J in the closure body without requiring special internal support structures or bearing members adjacent the interior surface of the valve cylindrical portion 96J. This permits the region adjacent the interior surface of the cylindrical portion 96J to be substantially open, free, and clear so as to minimize any restriction on the flow of the container contents through the passage 62J.

A novel valve support system is provided by the insert ring 90J. In particular, as shown in FIGS. 32 and 33, the support ring 90J includes a central support member 68J within the dispensing aperture of the closure body. The support member 68J has an upwardly facing concave surface 74J which is surrounded by a flat, annular, peripheral surface 76J. The support member 68J is connected with the ring inner collar 64J by radially oriented arms 80J.

The valve 70J functions in the same manner as the valve 70 described above with reference to the first embodiment illustrated in FIGS. 1-9 and 11. The valve 70J may be fabricated from the same materials discussed with reference to the valve 70 used in the first embodiment.

The closure 40J is preferably provided with a lid 120J. The lid 120J may be a separate, unconnected component which may be placed on, and removed from, the closure body 50J. Preferably, the lid 120J is mounted to an edge of the closure body 50J as illustrated in FIG. 31. The lid 120J is adapted to be pivoted between (1) a closed position (FIG. 34) over the closure top wall 58J and valve 70J and (2) an open position spaced away from the top wall 58J and valve 70J (FIG. 33).

Preferably, the lid 120J and closure body 50J are molded as a unitary structure from suitable thermoplastic materials, such as polypropylene or polyethylene. In the preferred embodiment, the lid 120J is connected to the closure body 50J by suitable means, such as a conventional living, film hinge 124J as illustrated in FIGS. 33 and 34. Such a hinge 124J is formed integrally with the closure housing 50J and lid 120J.

The lid 120J can be held or maintained in the fully opened position illustrated in FIG. 33 by means of an interference fit. Specifically, the closure body skirt 52J includes a recess 123J which is open to the exterior surface of the skirt. The lid 120J includes a suitable projection 125J which can be forced into the slot 123J when the lid 120J is in the fully opened position as illustrated in FIG. 33. The walls of the slot 123J and/or the projection 125J have a sufficient resiliency to accommodate an interference fit. Thus, when the lid 120J is fully opened as illustrated in FIG. 33, the container can be inverted to dispense the contents, and the lid 120J will not fall forward into the dispensing stream.

A feature of the preferred embodiment of the closure of the present invention prevents inadvertent discharge or leakage of the container contents out of the closure This feature relies on a unique cooperation between the closure lid 120J, the valve 70J, and the support member 68J.

Specifically, the closure lid 120J, as best illustrated in FIGS. 31, 33, and 34, includes an annular sealing collar 160J for engaging the valve central wall 92J when the lid 120J is closed as illustrated in FIG. 34. The collar 160J forces the valve central wall 92J against the closure body support member 68J so as to seal the valve closed around the slits 94J (FIG. 31).

Preferably, the lid 120J also includes an outer annular sleeve 170J that is shorter than the annular sealing collar 160J. The lid 120J further includes lugs 172J (FIG. 31) which are circumferentially spaced apart around the inner periphery of the lid sleeve 170J. The lugs 172J are unitary with the lid sleeve 170J, and each lug 172J has an end surface that is coplaner with the sleeve end surface.

The lugs 172J and sleeve 170J function to force a peripheral, annular flat surface 178J of the valve 70J downwardly when the lid is closed (FIG. 34). This helps to deform the valve central wall 92J downwardly to conform with the support member 68J so that the valve slits 94J are effectively sealed within the annular sealing collar 160J.

Further, to ensure that the sealing collar 160J effectively engages the valve central wall 92J, the sealing collar 160J preferably has a frustoconical end surface 180J. The frustoconical end surface 180J has the same orientation as a line tangent to the support member concave surface 74J at a point axially aligned with a selected point on the end surface 180J when the lid is closed.

When the closure lid 120J is open, the valve 70J, owing to its inherent resiliency, returns to its original, unstressed configuration (FIG. 33). In that configuration, the valve central wall 92J is spaced upwardly from the support member concave surface 74J (FIG. 33), and the valve cylindrical portion 96J assumes its original, unstressed cylindrical configuration. In this configuration, the contents of the container may pass up through the dispensing passage 62J (FIG. 31) and out through the valve 92J when the pressure of the liquid is sufficient to overcome the resilient closure forces of the valve 70J.

In a preferred method for making the closure 40J, the closure body 50J and lid 120J are molded as a unitary structure from polypropylene in the orientation illustrated in FIG. 31. As the closure 40J is ejected from the mold (not illustrated), the lid 120J is moved by the mold into the fully closed position (FIG. 34). Next, the valve 70J is inserted into position against the closed lid 120J and against the clamping surface 111J. Subsequently, the retaining ring 90J is inserted into the snap-fit engagement with the closure body collar 51J so as to tightly clamp the valve 70J. The closure 40J is then ready for assembly onto a suitable container.

Preferably, the retainer ring 90J is also molded from suitable thermoplastic materials. The provision of the flat annular surface 76J around the concave support member surface 74J aids in the molding process. This eliminates having to mold an acute angle at the peripheral edge of the concave surface 74J. Such a sharp angle is difficult to mold and is more likely to break.

The use of the separate, bottom-insertable, snap-fit, retaining ring 90J accommodates the manufacture of the closure 40J and accommodates assembly of the components. In some applications, it may be desireable to hold the retaining ring 90J in place in the closure body 50J by additional or other means, such as sonic welding, adhesive bonding, chemically fused bonding, or friction welding bonding.

In any case, it is preferable to provide a reduced spacing between the ring 90J and the closure body seat 111J inwardly from the peripheral edge of the valve flange 98J. This provides a reduced volume region and requires substantially increased forces for valve removal.

The valve retention capability of the closure is increased even further by the provision of the unique projecting rings 115J on the closure body clamping surface 111J and by the rings 131J and spikes 130J on the ring clamping surface 112J. The spikes and rings increase the retaining force because they become embedded in the valve flange material or otherwise deform the valve flange material If desired, additional or other types of protrusions could be provided on the clamping surfaces 111J and 112J.

It will be readily observed from the foregoing detailed description of the invention and from the illustrations thereof that numerous other variations and modifications may be effected without departing from the true spirit and scope of the novel concepts or principles of this invention.

What is claimed is:

1. A dispensing closure suitable for an opening in a squeeze-type container which has cooperating means for engagement by said closure to secure said closure on said container, said closure comprising:

a body for attachment to said container at said container opening to define a dispensing passage for communication between the container interior and exterior through said container opening;

a flexible, self-sealing valve of the type which opens in response to increased container pressure, said valve being disposed in said body across said dispensing passage; and said body having a skirt with securing means for engaging said cooperating means on said container, said body further having top wall extending inwardly from said skirt to define said dispensing passage and to define a receiving cavity means for receiving said valve, said body including flexure means for permitting outward displacement of said receiving cavity means with a minimum of distortion, said flexure means including an annular channel located in said top wall radially outwardly of said receiving cavity means and opening upwardly around said receiving cavity means to define ar educed thickness section of said top wall to accommodate elongation of said section when said top wall is engaged by said container.

2. The closure in accordance with claim 1 in which said annular channel has a generally V-shaped cross-section and in which said receiving cavity means includes a collar within which said valve is disposed.

3. A dispensing closure suitable for an opening in a squeeze-type container, said closure comprising:

a body for attachment to said container at said container opening to define a dispensing passage for communicating between the container interior and exterior through said container opening;

a flexible, self-sealing valve of the type which opens in response to increased container pressure, said valve being disposed in said body across said dispensing passage, said valve including a flexible, concave, central wall disposed across at least a portion of said dispensing passage and defining at least one normally closed dispensing slit;

said body including a support member spaced below said valve central wall, said support member having a concave surface for engaging said valve central wall; and a lid for being disposed on said body in a closed position over said valve, said lid including an annular sealing collar for forcing said valve central wall against said support member to seal said valve closed around said slit.

4. A dispensing closure suitable for an opening in a squeeze-type container, said closure comprising:

a body for attachment to said container at said container opening to define a dispensing passage for communicating between the container interior and exterior through said container opening;

a flexible, self-sealing valve of the type which opens in response to increased container pressure, said valve being disposed in said body across said dispensing passage, said valve including a flexible, concave, central wall disposed across at least a portion of said dispensing passage and defining at least one normally closed dispensing slit;

said body including a support member spaced below said valve central wall; and a lid for being disposed on said body in a closed position over said valve, said lid including an annular sealing collar for forcing said valve central wall against said support member to seal said valve closed around said slit, said support member having a concave surface for engaging said valve central wall, said sealing collar having a frustoconical end surface that has the same orientation as a line tangent to said support member concave surface at a point axially aligned with a selected point on said end surface when said list is closed.

* * * * *